US006424134B2

(12) United States Patent
Morishita et al.

(10) Patent No.: US 6,424,134 B2
(45) Date of Patent: Jul. 23, 2002

(54) SEMICONDUCTOR INTEGRATED CIRCUIT DEVICE CAPABLE OF STABLY GENERATING INTERNAL VOLTAGE INDEPENDENT OF AN EXTERNAL POWER SUPPLY VOLTAGE

(75) Inventors: Fukashi Morishita; Akira Yamazaki; Yasuhiko Taito; Nobuyuki Fujii; Mihoko Akiyama; Mako Kobayashi, all of Hyogo (JP)

(73) Assignees: Mitsubishi Denki Kabushiki Kaisha; Mitsubishi Electric Engineering Company Limited, both of Tokyo (JP)

( * ) Notice: Subject to any disclaimer, the term of this patent is extended or adjusted under 35 U.S.C. 154(b) by 0 days.

(21) Appl. No.: 09/759,321

(22) Filed: Jan. 16, 2001

(30) Foreign Application Priority Data

Jul. 26, 2000 (JP) ..... 2000-224888

(51) Int. Cl.[7] ..... G05F 3/16
(52) U.S. Cl. ..... 323/313

(58) Field of Search ..... 323/312, 313, 323/314

(56) References Cited

U.S. PATENT DOCUMENTS 6,160,391 A * 12/2000 Banba ..... 323/313

FOREIGN PATENT DOCUMENTS

JP 5-47184 2/1993

* cited by examiner

*Primary Examiner*—Adolf Deneke Berhane
(74) *Attorney, Agent, or Firm*—McDermott, Will & Emery

(57) ABSTRACT

A semiconductor device includes a constant voltage generation circuit generating a constant voltage commonly to reference voltages corresponding to a plurality of internal voltages. The plurality of reference voltages are generated from the common constant voltage. Thus, the semiconductor device for generating internal voltages is implemented, which allows reduction in layout area and decrease in test time for voltage adjustment.

20 Claims, 10 Drawing Sheets

SEMICONDUCTOR INTEGRATED CIRCUIT DEVICE CAPABLE OF STABLY GENERATING INTERNAL VOLTAGE INDEPENDENT OF AN EXTERNAL POWER SUPPLY VOLTAGE

BACKGROUND OF THE INVENTION

1. Field of the Invention

The present invention relates to a configuration of an internal voltage generation circuit for internally generating an internal voltage used in a semiconductor device such as a semiconductor integrated circuit device. More particularly, the present invention relates to a semiconductor device including a reference voltage generation circuit for generating a reference voltage independent of an external power supply voltage and an internal voltage generation circuit for generating an internal voltage at a necessary level in accordance with the reference voltage.

2. Description of the Background Art

In semiconductor integrated circuit devices, a reference voltage generation circuit generating a reference voltage for setting a level of an internal voltage has been employed in many cases, in order to convert a level of an externally applied voltage to generate the internal voltage of a desired level. The reference voltage generation circuit can maintain a level of a reference voltage at a constant level without being affected by variation in an external power supply voltage and therefore, a level of an internal voltage set in accordance with the reference voltage can be kept constant to operate internal circuitry in a stable manner.

FIG. 16 is a block diagram schematically showing a configuration of a reference voltage generation section in a conventional semiconductor integrated circuit device. In FIG. 16, DRAM (dynamic random access memory) is shown as a typical semiconductor integrated circuit device. As shown in FIG. 16, a reference voltage generating circuitry includes: a constant current generation circuit 900 generating a constant current Icst; and reference voltage generation circuits 902, 904, 906 and 908, connected to the constant current generation circuit 900, performing current/voltage conversion on the constant current Icst to generate reference voltages Vrefs, Vrefi, Vrefd and Vrefb, respectively. Internal voltages used in the DRAM are generated in accordance with the reference voltages Vrefs, Vrefi, Vrefd and Vrefb.

An internal voltage generation circuitry further includes: a voltage down converter 910 generating an array power supply voltage Vdds supplied to an array circuit 920 in accordance with the reference voltage Vrefs; a voltage down converter 912 generating a periphery power supply voltage Vddi supplied to a peripheral circuit 922 in accordance with the reference voltage Vrefi; a boosted voltage generation circuit 914 generating a boosted voltage Vpp in accordance with the reference voltage Vrefd; and a boosted voltage generation circuit 916 generating a boosted voltage Vddb in accordance with the reference voltage Vrefb.

The boosted voltage generation circuit 914 is provided with: a voltage divider circuit 911 dividing the boosted voltage Vpp generated by the boosted voltage generation circuit 914; and a detection circuit 913 comparing an output voltage of the voltage divider circuit 911 with the reference voltage Vrefb to control a voltage boosting operation of the boosted voltage generation circuit 914 in accordance with the comparison result. The boosted voltage Vpp from the boosted voltage generation circuit 914 is supplied to, for example, a boosted voltage utilizing circuit 924 such as a word line drive circuit.

The boosted voltage generation circuit 916 is provided with: a voltage divider circuit 915 voltage-dividing the boosted voltage Vddb; and a detection circuit 917 comparing an output voltage of the voltage divider circuit 915 with the reference voltage Vrefb to activate/deactivate a voltage boosting operation of the boosted voltage generation circuit 916 in accordance with the comparison result. The boosted voltage Vddb is supplied to a boosted voltage utilizing circuit 926 including, for example, a bit line isolation instructing signal generation circuit, a bit line equalize signal generation circuit and others.

The array circuit 920 includes, for example, a memory cell array; a sense amplifier circuit performing sensing and amplification of data of memory cells. The peripheral circuit 922 includes a control circuit generating an internal operation control signal and others.

Levels of the power supply voltages Vdds and Vddi generated by voltage down converters 910 and 912 are determined in accordance with the reference voltages Vrefs and Vrefi, respectively. Likewise, levels of boosted voltages Vpp and Vddb are determined by voltage-division ratios of the voltage divider circuits 911 and 915 and levels of the reference voltages Vrefd and Vrefb. Therefore, the voltage down converters 910 and 912 and the boosted voltage generation circuits 914 and 916 are required to generate the voltages Vdds, Vddi, Vpp and Vddb in a stable manner in order to operate the circuits 920, 922, 924 and 926 in a stable manner. That is, since levels of these voltages are determined by the reference voltages, the reference voltage generation circuits 902, 904, 906 and 908 have to generate the reference voltages Vrefs, Vrefi, Vrefd and Vrefb in a stable manner. Especially, it is very important to generate the reference voltages Vrefs, Vrefi, Vrefd and Vrefb with high precision since operating characteristics of internal circuits such as the array circuit 920 are determined by levels of the voltages Vdds, Vddi, Vpp and Vddb.

FIG. 17 is a graph showing a characteristic of a reference voltage. In FIG. 17, one of the reference voltages Vrefs, Vrefi, Vrefd and Vrefb shown in FIG. 16 is represented as a reference voltage Vref. As an externally applied voltage (external power supply voltage) rises, a constant current Icst from the constant current generation circuit 900 increases, and the reference voltage Vref rises with rise in the externally applied voltage (external power supply voltage). The region in which a voltage level of the reference voltage Vref rises is called a linear region.

When the externally applied voltage (external power supply voltage) reaches a certain voltage level, the constant current Icst from the constant current generation circuit 900 shown in FIG. 16 becomes constant and in response, the reference voltage Vref is made constant as well. Accordingly, when the externally applied voltage increases beyond the certain voltage value, a level of the reference voltage Vref is kept at a constant value independent of a level of the externally applied voltage (external power supply voltage). The region in which the reference voltage Vref is at a constant level is called a flat region.

Internal circuitry such as the array circuit is operated in the flat region in which the reference voltage Vref is constant. Thus, a reference voltage is generated stably independently of variations in the externally applied voltage (external power source voltage), thereby enabling generation of a stable internal voltage.

FIG. 18 is a block diagram schematically showing a configuration of a reference voltage generating circuit shown in FIG. 16. The reference voltage generation circuits

902, 904, 906 and 908 have substantially the same configurations as one another, except for that levels of the reference voltages generated by these circuits are different from one another. In FIG. 18, the reference voltage generation circuit 930 is shown representably.

As shown in FIG. 18, the reference voltage generation circuit 930 includes: a current source 930*a* for generating a constant current corresponding to the constant current Icst from the constant current generating circuit 900; a trimmable impedance element 930*b* for converting the constant current Icst from the current source 930*a* to a voltage level; and a tuning mechanism 930*c* for adjusting an impedance value of the trimmable impedance element 930*b*. A stabilization capacitance 930*d* for stabilizing the reference voltage Vref is provided at an output node 930*f* of the reference voltage generation circuit 930.

In the reference voltage generation circuit 930, a current flows through the trimmable impedance element 930*b* from the current source 930*a* normally. Hence, in order to reduce a current in a standby state, an impedance value of the trimmable impedance element 930*b* is set so sufficiently large as to sufficiently reduce an amount of the current Icst supplied by the current source 930*a*. For the constant current of a minute current amount, the stabilization capacitance 930*d* is provided for holding the reference voltage Vref in a stable manner without an influence of noise. The reference voltage Vref rises according to an externally applied voltage after power is switched on as shown in FIG. 17. Since an internal voltage (Vdds or the like) is generated in accordance with a reference voltage Vref, a rise time (a time required for a voltage to reach a definite state) of the internal voltage (Vdds or the like) conforms to a rise time of the reference voltage.

While the reference voltage Vref has to be set to a value as designed, variations in the reference voltage occur in level in actual semiconductor devices because of fluctuations in a fabrication process parameter or the like. Causes for the variations are, for example, variations in threshold voltage and operating current of transistors in the constant current generation circuit and the reference voltage generation circuit 930. The level of the reference voltage Vref is checked for each semiconductor chip fabricated actually. The tuning mechanism 930*c* is incorporated in the reference voltage generation circuit 930 in order to adjust the reference voltage level to an intended voltage level in accordance with the checking result. In a case where the trimmable impedance element 930*b* is constituted, for example, utilizing a channel resistance of a MOS transistor (an insulated gate field effect transistor), the channel resistance is required to be sufficiently large in order to supply a minute current (for example, an MOS transistor with a total channel length L of hundreds of $\mu$m for a channel width of 4 $\mu$m has to be equivalently used), which causes a problem that a layout area of the trimmable impedance element 930*b* becomes large.

Further, the tuning mechanism 930*c* is required to be provided for adjusting an impedance value of the trimmable impedance element 930*b*, which causes another problem of additionally increasing a layout area of the reference voltage generation circuit. The tuning mechanisms 930*c* are included in the respective reference voltage generation circuits 902, 904, 906 and 908 shown in FIG. 16. Hence, the reference voltages Vref (Vrefs, Vrefi, Vrefd and Vrefb) require individual voltage level adjustment operations for each device in the final step of a device fabrication process. The trimming step of adjusting a reference voltage level is performed in a test step after completion of device fabrication at a wafer level, thus resulting in increase in length of a test time.

For example, Japanese Patent Laid-Open No. 5-47184 discloses a configuration in which a reference voltage generation circuit is provided commonly to a plurality of internal voltage circuits. In this prior art, however, adjustment of an internal voltage level is performed for each internal voltage generation circuit to individually generate an internal voltage at an intended level. Therefore, characteristics of each internal voltage generation circuit have to be adjusted at a design stage, thereby causing a problem of deteriorating design efficiency.

Further, an internal voltage is level-converted for comparison with a reference voltage, in order to generate the internal voltages at different levels from the same reference voltage, and a through current is required to conduct for the level conversion normally. The internal voltage generation circuit is to supply a voltage direct to an internal circuit, and is set to consume a large current, thereby causing a problem that a through current is large corresponding to a large consumed current.

SUMMARY OF THE INVENTION

It is an object of the present invention to provide a semiconductor device capable of generating a necessary reference voltage in a stable manner with a reduced occupancy area.

It is another object of the present invention to provide a semiconductor device capable of shortening a test time for adjusting a level of a reference voltage.

A semiconductor device according to the present invention includes: a constant current generation circuit for generating a constant current; a current/voltage conversion circuit according to the constant current from the constant current generation circuit for generating a constant voltage; a voltage distribution circuit for receiving the constant voltage to generate at least one reference voltage; and an internal voltage generation circuit for generating a plurality of internal voltages in accordance with the reference voltage received from the voltage distribution circuit.

The current/voltage conversion circuit generating a constant voltage is provided to the voltage distribution circuit and one or more reference voltages are generated using the constant voltage to further generate an internal voltage or internal voltages from the one or more reference voltages. Hence, there is no necessity to provide a current/voltage conversion circuit to each reference voltage, thereby decreasing a layout area. Furthermore, the current/voltage conversion circuit is provided commonly to one or more reference voltages and a level(s) of the reference voltage(s) can be adjusted only by level tuning of one constant voltage, thereby enabling reduction of time in tuning of a voltage level.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Fundamental Configuration

Figure 1:
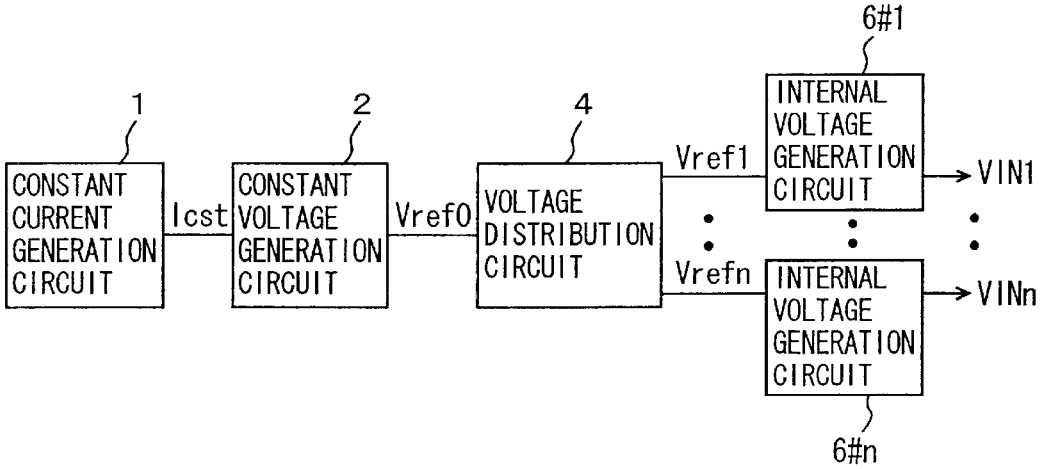
FIG. 1 is a block diagram schematically showing the entire configuration of a semiconductor device according to the present invention.

FIG. 1 is a block diagram schematically showing a fundamental configuration of a semiconductor device according to the present invention. In FIG. 1, the semiconductor device according to the present invention includes: a constant current generation circuit 1 generating a constant current Icst; a constant voltage generation circuit 2 performing current/voltage conversion of converting the constant current Icst to a voltage to generate a constant voltage Vref0; a voltage distribution circuit 4 generating a plurality of reference voltages Vref1 to Vrefn in accordance with the constant voltage Vref0; and internal voltage generation circuits 6#1 to 6#n generating internal voltages VIN1 to VINn in accordance with the reference voltages Vref1 to Vrefn.

In the configuration shown in FIG. 1, one constant voltage Vref0 is generated for a plurality of the internal voltages VIN1 to VINn from the constant voltage generation circuit 2. The voltage distribution circuit 4, whose configuration will be explained in detail later, buffers the constant voltage Vref0 in an analogue fashion to generate the reference voltages Vref1 to Vrefn corresponding to the respective internal voltages VIN1 to VINn. Hence, the constant voltage generation circuit 2 can be provided commonly to the internal voltage generators 6#1 to 6#n and dissimilar to a conventional device, there is no necessity to provide constant voltage generation circuits 2 to the respective internal voltage generation circuits 6#1 to 6#n, thereby decreasing a circuit layout area.

Further, in the voltage distribution circuit 4, the constant voltage Vref0 is buffered analoguely to generate the reference voltages Vref1 to Vrefn whose levels are equal to or different from each other. This analog buffer circuit is not required to have a large current driving ability and can be fabricated in a small occupancy area, and a layout area of the voltage distribution circuit 4 can be sufficiently smaller as compared with the constant voltage generation circuit 2.

Further, by tuning a level of the constant voltage Vref0, levels of the reference voltages Vref1 to Vrefn from the voltage distribution circuit 4 are also adjusted according to the tuning, and therefore, the tuning processing has only to be performed in the constant voltage generation circuit 2, which leads to reduction in tuning time to a greater extent, resulting in a shorter test time, as compared with a configuration in which constant voltage generation circuits (reference voltage generation circuits) are provided to the respective internal voltage generation circuits 6#1 to 6#n to perform the tunings on the respective reference voltage generation circuits.

Figure 2:
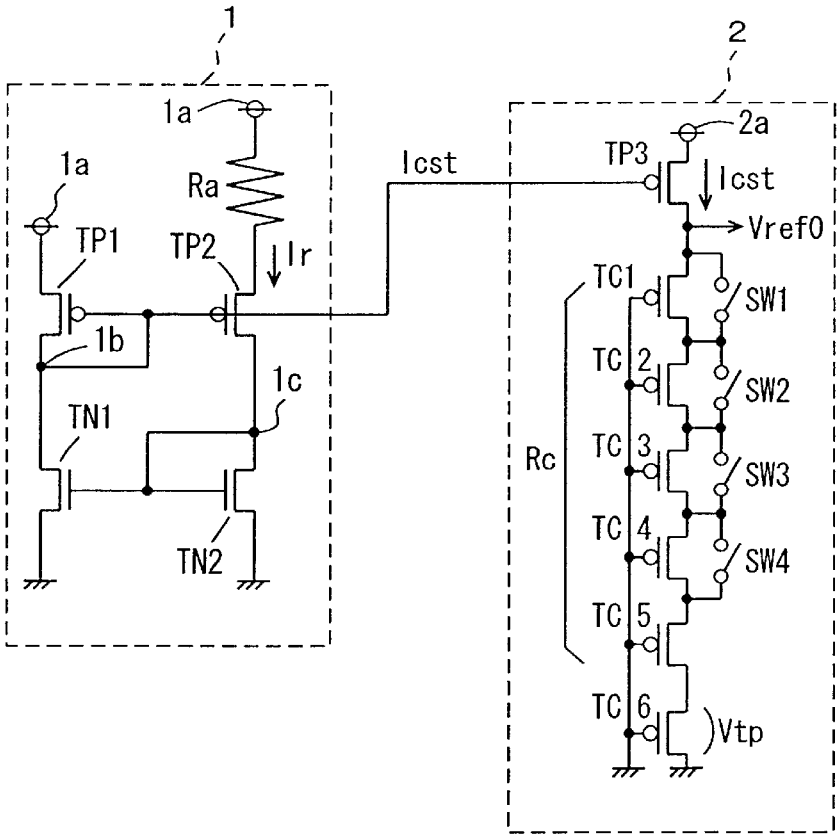
FIG. 2 is a circuit diagram representing a configuration of a constant current generation circuit and a constant voltage generation circuit shown in FIG. 1.

FIG. 2 is a circuit diagram representing configurations of the constant current generation circuit 1 and the constant voltage generation circuit 2 shown in FIG. 1. Referring to FIG. 2, the constant current generation circuit 1 includes: a P channel MOS transistor TP1 connected between a power supply node 1*a* and an internal node 1*b*, and having a gate connected to the internal node 1*b*; a resistance element Ra and a P channel MOS transistor TP2 connected in series between the power supply node 1*a* and an internal node 1*c*; an N channel MOS transistor TN1 connected between the internal node 1*b* and a ground node, and having a gate connected to the internal node 1*c*; and an N channel MOS transistor TN2 connected between the internal node 1*c* and the ground node, and having a gate connected to the internal node 1*c*. The internal node 1*b* serves as an output node of the constant current generation circuit 1.

The MOS transistors TP1 and TP2 are set to have a ratio of size (a ratio of a channel width W to a channel length L) of 1 to 10, for example. The MOS transistors TN1 and TN2 are each set to have a sufficient large channel resistance, and therefore, only a small current flows through each of MOS transistors TN1 and TN2.

The MOS transistors TN1 and TN2 constitute a current mirror circuit. When MOS transistors TN1 and TN2 each have a sufficient large channel resistance, MOS transistors TP1 and TP2 each operate substantially in a sub-threshold region. In this case, the currents of the same magnitude flow through the MOS transistors TP1 and TP2 due to the action of the N channel MOS transistors TN1 and TN2 constituting the current mirror circuit. A ratio of a channel width to a channel length of the MOS transistor TP2 is set sufficiently larger than that of the MOS transistor TP1. Hence, source voltage levels of the MOS transistors TP1 and TP2 are different from each other. That is, a source to gate voltage of the MOS transistor TP2 is smaller than that of the MOS transistor TP1. A voltage drop at a source node of the MOS transistor TP2 is caused by the resistance element Ra. A voltage drop ΔV across the resistance element Ra is expressed by the following formula:

$$\Delta V = k \cdot \theta / q \cdot ln((W2/L2)/(W1/L1))$$

where k is Boltzmann's constant, θ is an absolute temperature, q is an electric charge and further, W2/L2 and W1/L1 indicate ratios of a channel width to channel length of MOS transistors TP2 and TP1, respectively. Accordingly, A current Ir flowing through the resistance element Ra is expressed by the following formula:

$$Ir = \Delta V / Ra.$$

Therefore, a current Ir (=Icst) independent of a voltage of external power supply node 1*a* is generated in the constant current generation circuit 1.

The constant voltage circuit 2 includes: a P channel MOS transistor TP3 connected between a power supply node 2*a* and an internal node 2*b*, and having a gate connected to the internal node 1*b* in the constant current generation circuit 1; P channel MOS transistors TC1 to TC6 connected in series between the internal node 2*b* and a ground node; and switching elements SW1 to SW4 connected in parallel with the respective MOS transistors TC1 to TC4.

The MOS transistor TP3 has the same size (a ratio of a channel width to a channel length) as that of the MOS transistor TP1, and in the MOS transistor TP3, a current of the same magnitude as a current flowing through the MOS transistor TP1, or the constant current Icst flows.

The MOS transistors TC1 to TC5 each have a sufficiently large channel resistance compared with the MOS transistor TC6, and each causes a voltage drop due to each respective channel resistance. On the other hand, as for the MOS transistor TC6, a channel resistance thereof is small and the gate and drain thereof are connected to ground nodes, and MOS transistor TC6 causes a voltage drop equal to the absolute value Vtp of a threshold voltage thereof.

The switching elements SW1 to SW4 are constituted of, for example, fuse elements, and each short-circuits a corresponding MOS transistor when being conductive. Hence, with a combined channel resistance of the MOS transistors TC1 to TC5 being Rc, the constant voltage Vref0 generating on the internal node 2*b* is expressed by the following formula:

$$Vref0 = Rc \cdot Icst + Vtp.$$

Accordingly, the constant voltage Vref0 is a voltage at a constant level independent of a level of a voltage applied from an outside (an external power supply voltage, or the voltage applied on the nodes 1*a* and 2*a*). By setting the switching elements SW1 to SW5 selectively to an conductive state, a value of the combined channel resistance Rc can be adjusted and thereby a level of the constant voltage Vref0 can be adjusted.

In the constant voltage generation circuit 2, a through current flows from the power supply node 2*a* to the ground nodes. A value of the combined channel resistance Rc is set sufficiently large in order to restrict the through current to a small value in a standby state. Hence, the MOS transistors TC1 to TC5 are each set to have a sufficiently large channel length. For example, the combined channel resistance Rc is on the order of MΩ and the constant current Icst is of the order of 0.5 μA. Therefore, in a case where a channel width W is, for example, 4 μm in the MOS transistors TC1 to TC6, a total channel length L is hundreds of μm, thus resulting in a somewhat large layout area. The constant voltage generation circuit 2 is, however, provided commonly to the internal voltage generation circuits 6#1 to 6#n, and therefore, while the layout area is somewhat large, the number of constant voltage generation circuits 2 is reduced, thereby enabling a layout area of reference voltage generation circuitry to decrease greatly as compared with a conventional example.

Further, the switching elements SW1 to SW4 serve as the tuning mechanism for adjusting a level of constant voltage Vref0. The switching elements are fuse elements or switching transistors selectively rendered conductive by fuse-programmed control signals. Therefore, since occupancy areas of the switching elements SW1 to SW4 are relatively large, a layout area of the constant voltage generation circuit 2 is further larger. In this case, however, the constant voltage generation circuit 2 is also provided commonly to the reference voltages Vref1 to Vrefn for the internal voltage generation circuits 6#1 to 6#n, and therefore, while the layout area of the constant voltage generation circuit 2 is relatively large, the layout area of reference voltage generation circuitry can be still sufficiently smaller as a whole, compared with a case where constant voltage generation circuits 2 are provided to the respective internal voltage generation circuits.

As described above, according to the fundamental configuration of the present invention, the constant voltage generation circuit 2 for generating the constant voltage Vref0 for common use by the reference voltages Vref1 to Vrefn for a plurality of the internal voltages VIN1 to VINn, and therefore, while a layout area the reference voltage generating circuitry is relatively large, a total layout area required for generation of each of the reference voltages can be sufficiently smaller. Further, the voltage distribution circuit 4 simply performs a buffering processing on the constant voltage Vref0 and sizes of components thereof are sufficiently small, thereby enabling a layout area for the voltage distribution circuit to be sufficiently small.

Modification

Figure 3:
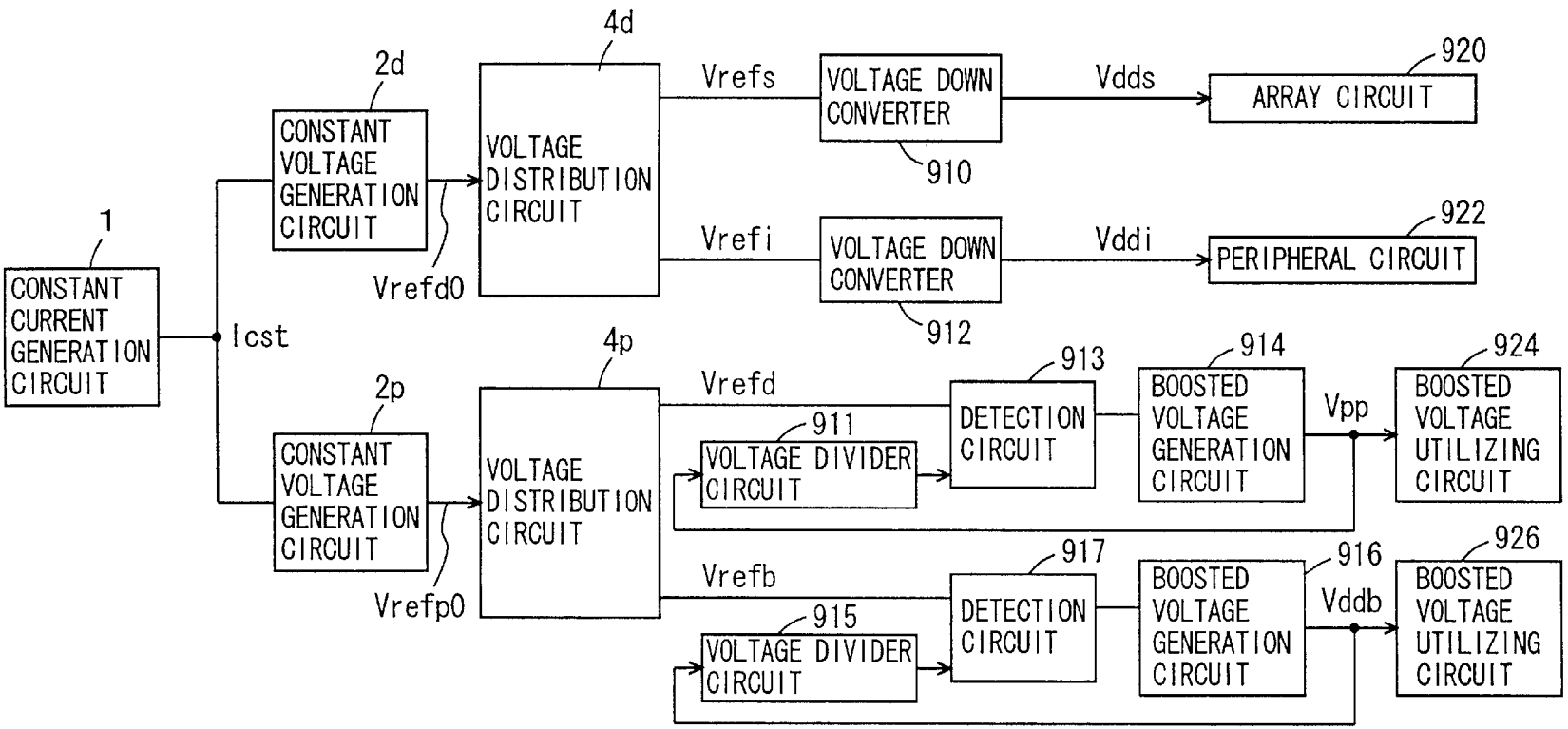
FIG. 3 is a block diagram schematically showing a modification of a semiconductor device according to the present invention.

FIG. 3 is a block diagram schematically showing a modification of a fundamental configuration of the semiconductor device according to the present invention. FIG. 3 shows a configuration for an internal voltage generated in DRAM. In the configuration shown in FIG. 3, there are provided: a constant voltage generation circuit 2*d* for generating a constant voltage Vrefd0 serving as a reference for power supply voltages Vdds and Vddi for use in an array circuit 920 and a peripheral circuit 922, respectively; and a constant voltage generation circuit 2*p* for generating a constant voltage Vrefp0 serving as a reference for boosted voltages Vpp and Vddb supplied to boosted voltage utilizing circuits 924 and 926. The constant voltage generation circuits 2*d* and 2*p* commonly receive a constant current Icst from a constant current generation circuit 900.

A voltage distribution circuit 4*d* is provided to the constant voltage generation circuit 2*d* and a voltage distribution circuit 4*p* is provided to the constant voltage generation circuit 2*p*. The voltage distribution circuit 4*d* generates reference voltages Vrefs and Vrefi in accordance with the constant voltage Vrefd0 to supply the reference voltages Vrefs and Vrefi to voltage down converters 910 and 912. The voltage down converters 910 and 912 are each constructed of a comparison circuit for comparing a voltage corresponding to a power supply voltage with a reference voltage; and a current source transistor for supplying a current to an internal power supply line according to an output of the comparison circuit. Levels of internal power supply voltages Vdds and Vddi are determined in accordance with the respective reference voltages Vrefs and Vrefi.

On the other hand, the voltage distribution circuit 4*p* generates the reference voltages Vrefd and Vrefb from the constant voltages Vrefp0 to supply the reference voltages Vrefd and Vrefb to the detection circuits 913 and 917, respectively. Boosted voltage generation circuits 914 and 916 each perform, for example, a charge pumping operation under control of the detection circuits 913 and 917 to generate boosted voltages Vpp and Vddp.

The detection circuits 913 and 917 compare output voltages of voltage divider circuits 911 and 915 voltage-dividing the boosted voltages Vpp and Vddb with the respective reference voltages Vrefd and Vrefb. Accordingly, levels of the boosted voltages Vpp and Vddb are determined by division ratios of the voltage divider circuits 911 and 915 and corresponding reference voltages.

As shown in FIG. 3, the constant voltage generation circuits 2*d* and 2*p* are provided separately to respective combinations of the power supply voltages Vdds and Vddi, and of the boosted voltages Vpp and Vddb depending on the kinds of internal voltages. In this case as well, a layout area can be reduced as compared with a configuration in which reference voltage generation circuits are provided corresponding to the respective reference voltages Vrefs, Vrefi, Vrefd and Vrefb. Further, with the constant voltage generation circuits 2*d* and 2*p*, levels of the constant voltages Vrefd0 and Vrefp0 can be set to optimal levels according to the levels of internal voltages.

As described above, according to the present invention, a circuit for generating a constant voltage used for generating internal voltages is provided commonly to a plurality of internal voltages, thereby enabling reduction in layout area to a great extent.

First Configuration of Voltage Distribution Circuit

Figure 4A:
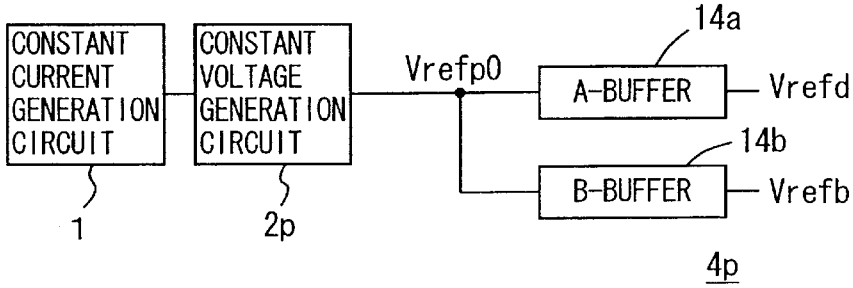
FIG. 4A is a block diagram schematically showing a first configuration of a voltage distribution circuit according to the present invention.

FIG. 4A is a block diagram representing a configuration of the voltage distribution circuit 4*p* shown in FIG. 3. Referring to FIG. 4A, the voltage distribution circuit 4*p* includes: an A-buffer 14*a* for analoguely buffering the constant voltage Vrefp0 from the constant voltage generation circuit 2*p* to generate the reference voltage Vrefd; and a B-buffer 14*b* for buffering the constant voltage Vrefp0 analoguely to generate the reference voltage Vrefb. The A-buffer 14*a* generates the reference voltage Vrefd of the same level as the constant voltage Vrefp0. On the other hand, the B-buffer 14*b* generates the reference voltage Vrefd of a level different from the constant voltage Vrefp0.

Figure 4B:
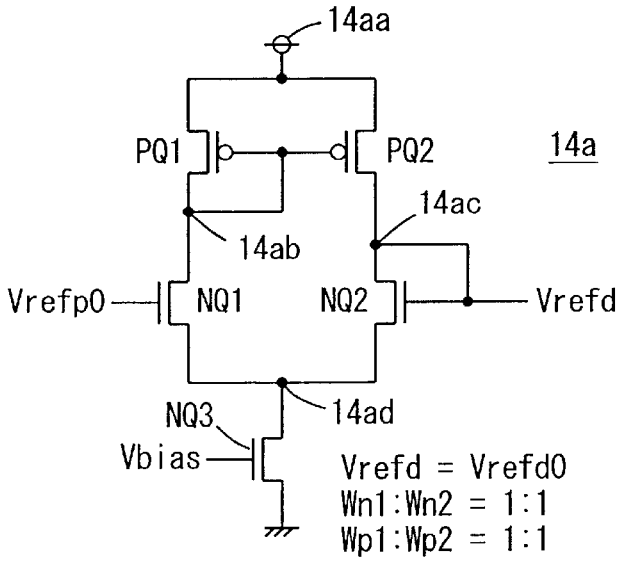
FIG. 4B is a circuit diagram representing a configuration of an A-buffer shown in FIG. 4A

FIG. 4B is a circuit diagram representing a configuration of the A-buffer 14*a* shown in FIG. 4A. In FIG. 4B, the A-buffer 14*a* includes: a P channel MOS transistor PQ1 connected between a power supply node 14*aa* and internal node 14*ab*, and having a gate connected to the node 14*ab*; a P channel MOS transistor PQ2 connected between the power supply node 14*aa* and a node 14*ac*, and having a gate connected to the node 14*ab*; an N channel MOS transistor NQ1 connected between the node 14*ab* and a node 14*ad*, and receiving the constant voltage Vrefp0 at a gate thereof; an N channel MOS transistor NQ2 connected between the node 14*ac* and the node 14*ad*, and receiving the reference voltage Vrefd at a gate thereof; and an N channel MOS transistor NQ3 connected between the node 14*ad* and a ground node, and receiving a bias voltage Vbias at a gate thereof. The gate of the MOS transistor NQ2 is connected to the node 14*ac*. That is, in the A-buffer 14*a*, one of inputs of MOS transistors NQ1 and NQ2 (the gates of MOS transistors NQ1 and NQ2) constituting a differential stage is connected to an output node thereof.

The MOS transistors PQ1 and PQ2 constitutes a current mirror circuit. The MOS transistors PQ1 and PQ2 have channel lengths L equal to each other, and when the MOS transistors NQ1 and NQ2 have channel lengths L equal to each other, the channel widths Wp1 and Wp2 of the respective MOS transistor PQ1 and PQ2 are set to be equal to each other and in addition, the channel widths Wn1 and Wn2 of the respective MOS transistor NQ1 and NQ2 are also set to be equal to each other. Accordingly, currents of the same magnitude as each other (a mirror ratio is 1) flow through the MOS transistors PQ1 and PQ2 respectively.

The bias voltage Vbias is, for example, at an intermediate level of 1 V, and controls a current amount supplied by the current mirror stage (MOS transistors PQ1 and PQ2).

In the A-buffer 14*a* shown in FIG. 4B, when the reference voltage Vrefd is higher than the constant voltage Vrefp0, a conductance of the MOS transistor NQ2 attains larger than that of the MOS transistor NQ1, and a current amount flowing through the MOS transistor NQ2 is increased. The MOS transistor PQ1 constitutes a master stage in the current mirror stage, and therefore, in this case, a voltage level on the node 14*ac* decreases and accordingly, a level of the reference voltage Vrefd decreases. On the other hand, when a level of the reference voltage Vrefd is low, the MOS transistor NQ2 cannot discharge all of a current supplied from the MOS transistor PQ2 and thereby, a voltage from the node 14*ac*, that is, the reference voltage Vrefd rises in level. Hence, the reference voltage Vrefd is at the same level as the constant voltage Vrefp0.

The A-buffer 14*a* is, as shown in FIG. 4B, a differential amplifier with a gain of 1 and by connecting the node 14*ac* (output) and the input of the differential stage, the constant voltage Vrefp0 and the reference voltage Vrefd can have the same level as each other.

Figure 4C:
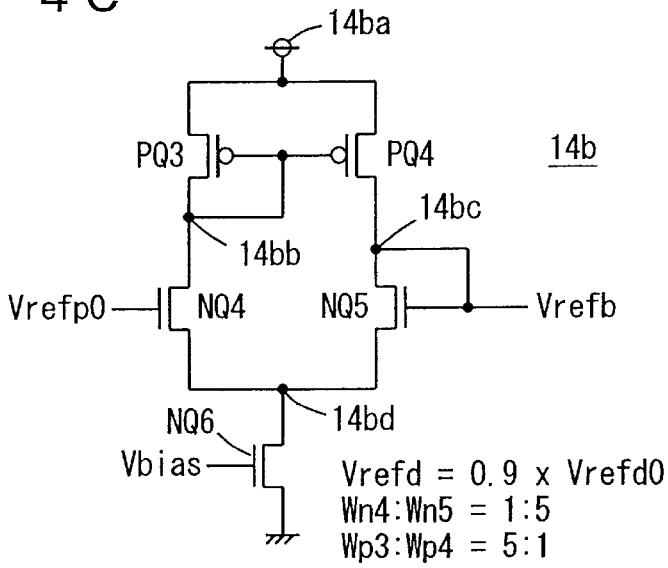
FIG. 4C is a circuit diagram representing a configuration of a B-buffer of FIG. 4A.

FIG. 4C is a circuit diagram representing a configuration of the B-buffer 14*b* shown in FIG. 4A. In FIG. 4C, the B-buffer 14*b* includes; P channel MOS transistor PQ3 connected between a power supply node 14*ba* and an internal node 14*bb*, and having a gate connected to a node 14*bb*; P channel MOS transistor PQ4 connected between the power supply node 14*ba* and a node 14*bc*, and having a gate connected to the node 14*bb*; an N channel MOS transistor NQ4 connected between the node 14*bb* and a node 14*bd*, and receiving the constant voltage Vrefp0 at a gate thereof; an N channel MOS transistor NQ5 connected between the node 14*bc* and the node 14*bd*, having a gate connected to the node 14*bc*, and receiving the reference voltage Vrefb at a gate thereof; and an N channel MOS transistor NQ6 connected between the node 14*bd* and a ground node, and receiving the bias voltage Vbias at a gate thereof.

The MOS transistors PQ3 and PQ4 constitute a current mirror stage and the N channel MOS transistors NQ4 and NQ5 constitute a differential stage. The node 14*bc* is an output node of the B-buffer 14*b* and an input node of the differential stage. The MOS transistors PQ3 and PQ4 have channel lengths equal to each other and a ratio of their channel widths Wp3 and Wp4 set to 5:1. That is, the P channel MOS transistor PQ3 has a current driving ability 5 times as large as that of the MOS transistor PQ4.

On the other hand, in the N channel MOS transistors NQ4 and NQ5, when their channel lengths are equal to each other, a ratio of their channel widths Wn4 and Wn5 is set to 1:5. Accordingly, in this case, the MOS transistor NQ5 is set to have a current driving ability 5 times as large as that of the MOS transistors NQ4.

In the B-buffer 14*b* shown in FIG. 4C, the MOS transistors PQ3 and PQ4 constitutes a current mirror stage with a mirror ratio of 1/5 and a current flowing through the MOS transistor PQ4 is of an amount 1/5 times as large as a current flowing through the MOS transistor PQ3. In a case where levels of the reference voltage Vrefb and the constant voltage Vrefp0 are equal to each other, much of a current flows through the MOS transistor NQ5, and therefore, a voltage level of the node bc decreases, and accordingly, a level of the reference voltage Vrefb0 decreases. When the reference voltage Vrefb decreases further and a conductance of the MOS transistor NQ5 decreases more and a current supplied by the MOS transistor PQ4 becomes to balance with a current discharged by the MOS transistor NQ5, and a level of the reference voltage Vrefb becomes sustained at the balancing point.

Under the conditions shown in FIG. 4C, the reference voltage Vrefb is maintained at a voltage level about 0.9 times as large as the constant voltage Vrefd0, which value is obtained by a simulation result. In the configuration of the differential amplifier circuit, when the reference voltage Vrefd varies by about 0.1 V, the mirror current varies by a factor of about 10. Hence, even when the reference voltage Vrefb varies a little, a current varies largely, and thus the reference voltage Vrefb can be maintained at a prescribed level.

The A and B-buffers 14*a* and 14*b* shown in FIGS. 14B and 14C can be configured by combining transistors each having a channel width W of 10 $\mu$m and a channel length L of 0.5 $\mu$m, thereby allowing sufficient reduction in layout area as compared with the constant voltage generation circuit employing a transistor having a large channel length (W=4 $\mu$m and L=hundreds of $\mu$m).

Further, in the A- and B-buffers 14*a* and 14*b*, the bias voltage Vbias is applied to the gates of the current source transistors NQ3 and NQ6 in order to restrict the currents. In general, a stabilization capacitance is provided in order to stabilize each of the voltages Vrefd and Vrefb. When sizes of the current source transistors NQ3 and NQ6 (a ratio of a channel width to a channel length) are changed, or when levels of the bias voltage Vbias are altered, rise times of the reference voltages Vrefd and Vrefb after power on can be altered individually, which enables setting of rise times of the reference voltages Vrefd and Vrefb generated by mirror currents.

For example, in a case where it is needed to rise the reference voltages Vrefd and Vrefb simultaneously, if one of the reference voltages reaches a high level faster than the other since output loads of the A- and B-buffers 14*a* and 14*b* differ from each other, sizes (ratios of a channel width and a channel length) of the current source transistors NQ3 and NQ6 are altered, thereby enabling establishing of the same rise times of the reference voltages Vrefd and Vrefb.

The A-buffer 14*a* generates the reference voltage Vrefb at the same level as the constant voltage Vrefp0. The output voltage of the constant voltage generation circuit 2*b* is generated at an output of a transistor having a large channel length L, and therefore its output impedance is very high. Accordingly, the reference voltage from the constant voltage generation circuit 2*b* is unstable and is liable to be affected by noise, and therefore, the output voltage is buffered analoguely in the A-buffer 14*a* (amplified in the differential amplifier with a gain of 1), thereby enabling reduction in the output impedance and improving noise immunity. Considering the fact that the reference voltages Vrefd and Vrefb are employed in various local regions of a semiconductor integrated circuit device, constant voltages are buffered by the A- and B-buffers 14*a* and 14*b*, and thereby noise immunity of the reference voltages can be improved.

As described above, according to the first configuration of the voltage distribution circuit, only one constant voltage generation circuit is employed for generation of two reference voltages, thereby enabling decrease in layout area and in addition, only one tuning mechanism is required, thereby enabling reduction in time required for the tuning.

It should be noted that in FIG. 4A, voltage distribution circuits for the boosted voltages Vpp and Vddb are shown. A similar configuration may, however, be used in the voltage distribution circuit 4*d* for the power supply voltages Vdds and Vddi shown in FIG. 3.

Second Configuration of Voltage Distribution Circuit

Figure 5A:
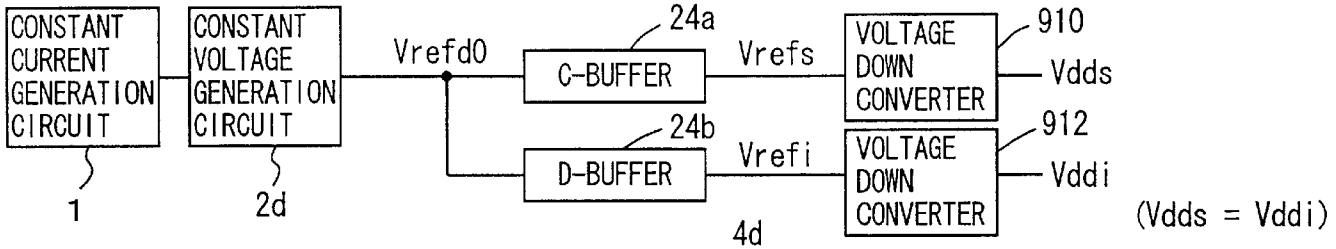
FIG. 5A is a block diagram schematically showing a second configuration of the voltage distribution circuit according to the present invention.

FIG. 5A is a block diagram schematically showing a second configuration of the voltage distribution circuit. In FIG. 5A, the voltage distribution circuit 4*d* includes C- and D-buffers 24*a* and 24*b* receiving a constant voltage Vrefd0 from a constant voltage generation circuit 2*d*. A reference voltage Vrefs from the C-buffer 24*a* is supplied to a voltage down converter 910 and a reference voltage Vrefi from the D-buffer 24*b* is supplied to a voltage down converter 912. The C- and D-buffers 24*a* and 24*b* generate the reference voltages Vrefs and Vrefi both having the same levels as the constant voltage Vref0. That is, a case is assumed where a power supply voltage Vdds for an array circuit generated from the voltage down converter 910 and a power supply voltage Vddi for a peripheral circuit generated from the voltage down converter 912 are equal to each other in voltage level. In this case, the array circuit and the peripheral circuit have different operation timings from each other and in addition, amounts of consumed currents are also mutually different, and therefore, the voltage down converters 910 and 912 are separately provided.

The C- and D-buffers 24*a* and 24*b* generate the reference voltages Vrefs and Vrefi having the same levels as the constant voltage Vrefs0. Hence, a configuration similar to that of the A-buffer 14*a* shown in FIG. 4B may be employed. In the configuration shown in FIG. 5A as well, only one constant voltage generation circuit 2*e* is provided commonly to the two reference voltage Vrefs and Vrefi, thereby enabling reduction in layout area of the reference voltage section and decrease in time required for tuning of the reference voltages.

First Example Modification

Figure 5B:
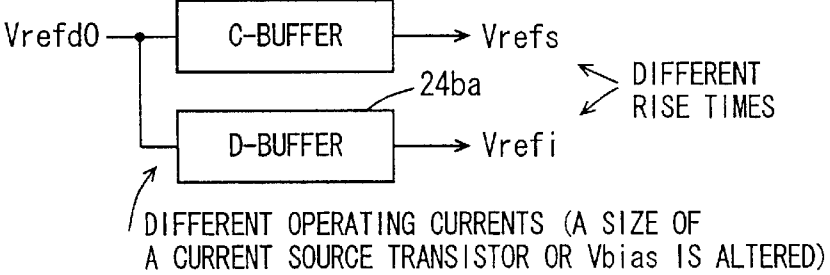
FIG. 5B is a block diagram representing a modification of the second configuration of the voltage distribution circuit.

FIG. 5B is a block diagram representing a modification of the second configuration of the voltage distribution circuit.

In FIG. 5B, operating currents of C- and D-buffers 24*aa* and 24*ba* are mutually different in magnitude. In order to implement the different operating currents, there are alternatives available: one is to alter a size (a ratio of a channel width and a channel length) of current source transistors (for example, the transistor NQ3 of FIG. 4B) in the C- and D-buffers 24*aa* and 24*ba*; and the other is to alter levels of a bias voltage Vbias to different levels. In a case where operating currents of the C- and D-buffers 24*aa* and 24*ba* are altered so as to be different from each other, rise times of the reference voltages Vrefs and Vrefi after power on are different from each other. By providing the buffers 24*aa* and 24*ba* separately to the constant voltage Vrefd0, rise times of internal voltages can be individually adjusted through rise time (a time required for a voltage to reach a definite state from power-on) of the reference voltage.

Figure 5C:
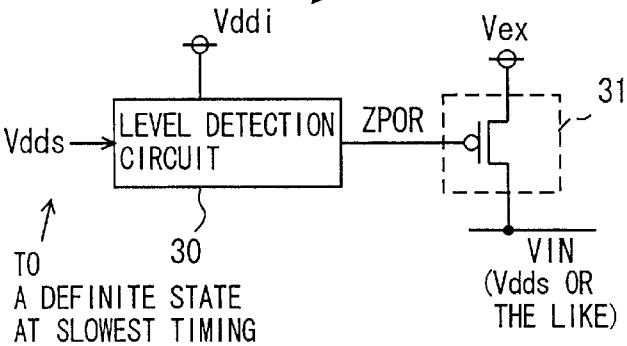
FIG. 5C is a block diagram representing an application example of the configuration of FIG. 5B.

Now, consideration is given to a case where an array power supply voltage Vdds rises slowest while a periphery power supply voltage Vdd rises fastest. In this case, as shown in FIG. 5C, with the periphery power supply voltage Vddi rising at fastest being an operating power supply voltage, a level of the array power supply voltage Vdds rising at slowest timing is detected by a level detection circuit 30. A power-on detection signal ZPOR from the level detection circuit 30 is supplied to an initial charge assist circuit 31 charging a signal line transmitting an internal voltage VIN. The initial charge assist circuit 31 supplies a current from an external power supply node to an internal voltage line during the time when the power-on detection signal ZPOR stays at a low level to assist the charging of the internal voltage VIN. That is, a charging ability of a circuit generating the internal voltage is increased till the array power supply voltage Vdds rising at the slowest timing reaches a stable voltage level, thereby causing the internal voltage to reach to a prescribed level at high speed.

It should be noted that the level detection circuit 30 is constituted of, for example, an inverter circuit, a input logic threshold voltage of the inverter circuit is sufficiently increased or a voltage divider circuit is provided at an input stage of such inverter circuit and a signal obtained by voltage division of the array power supply voltage Vdds is applied to the inverter circuit. According to such arrangement, when no difference in voltage is present between the periphery power supply voltage Vddi and the array power supply voltage Vdds, the power-on detection signal ZPOR can be easily maintained in an active state at L level after power is on till the array power supply voltage Vdds reaches to a prescribed level. The internal voltage may be either the power supply voltage Vdds or the boosted voltage Vpp.

Second Example Modification

Figure 5D:
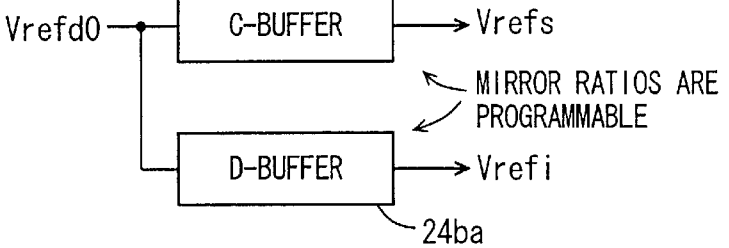
FIG. 5D is a block diagram representing a second a modification of the second configuration of the voltage distribution circuit.

FIG. 5D is a block diagram schematically showing a second example modification of the second configuration of the voltage distribution circuit. In the configuration shown in FIG. 5D, C- and D-buffers 24*ab* and 24*ba* are programmably set with respect to a mirror ratio. For example, transistors are provided at a current mirror stage in plural numbers in parallel to one another and a transistor to be used is connected between an internal node and a power supply node according to a required mirror ratio. By altering the mirror ratio, a level of the constant voltage Vrefd0, and levels of the reference voltages Vrefs and Vrefi can be made different. Hence, the same configuration can be easily adapted, through programming the mirror ratio, for the modification of the specification by making the levels of the reference voltages Vrefs and Vrefi different to alter the array power supply voltage Vdds and the periphery power supply voltage Vddi. Further, the C- and D-buffers 24*ab* and 24*ba* each have a programmable mirror ratio and levels of the reference voltages Vrefs and Vrefi can be adjusted independently of each other.

As described above, in the second configuration of the voltage distribution circuit 2, buffer circuits are provided corresponding to respective reference voltages derived from a common constant voltage to generate the reference voltages, and not only can levels of the reference voltages be individually adjusted but also the reference voltages can be stably generated as well. In addition, adjustment of rise times of the reference voltages can be performed further.

Third Configuration of Voltage Distribution Circuit

Figure 6:
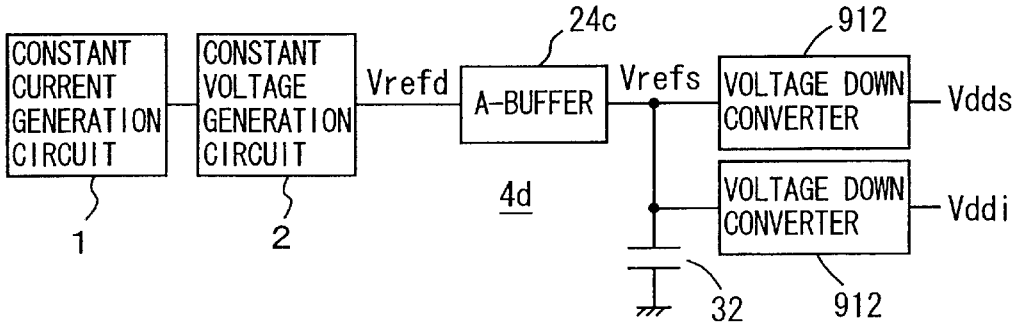
FIG. 6 is a block diagram schematically showing a third configuration of the voltage distribution circuit according to the present invention.

FIG. 6 is a block diagram schematically showing a third configuration of the voltage distribution circuit 4. In the configuration shown in FIG. 6, an A-buffer 24*c* is provided commonly to voltage down converters 910 and 912. The A-buffer 24C analoguely buffers a constant voltage Vrefd generated from a constant voltage generation circuit 2 to generate a reference voltage Vrefs. The A-buffer 24*c* is fabricated so as to make a size of each of transistors of components a little larger in order to supply the reference voltage Vrefs to the two voltage down converters 910 and 912. A stabilization capacitance 32 is provided for stabilizing the reference voltage Vrefs.

In the configuration shown in FIG. 6, the reference voltage Vrefs from the A-buffer 24*c* rises in a rise time of, for example, 100 $\mu$s. The voltage down converters 910 and 912 generates power supply voltages Vdds and Vddi in accordance with the reference voltage Vrefs. Accordingly, the power supply voltages Vdds and Vddi can be made to rise at the same time point, for example, with a rise time of 10 $\mu$s (enter to a definite state) and the power supply voltages for the internal circuits can be stabilized at the same time point. Even when the array circuit (see FIG. 3) using the array power supply voltage Vdds from the voltage down converter 910 and the peripheral circuit (see FIG. 3) using the periphery power supply voltage Vddi from the voltage down converter 912 have loads different from each other, the power supply voltages Vdds and Vddi can have the same rise time as each other by setting current driving abilities of the voltage down converters 910 and 912 according to respective output loads. Hence, the power supply voltages Vdds and Vddi can be driven to a stable state substantially at the same time point according to the constant voltages Vrefd from the constant current generation circuit 1 and the constant voltage generation circuit 2 after power is on.

Further, the array circuit using the array power supply voltage Vdds and the peripheral circuit using the periphery power supply voltage Vddi have their operation timings different from each other and therefore their current consumption timings are also different from each other. Therefore, by providing the voltage down converters 910 and 912 separately and individually to the array circuit and the peripheral circuit, respectively, currents can be supplied to the array circuit and the peripheral circuit in a stable manner according to respective operating timings of the array circuit and the peripheral circuit to operate these circuits in a stable manner.

As described above, according to the third configuration of the voltage distribution circuit, a constant voltage generation circuit is provided commonly to a plurality of internal circuits, thereby enabling reduction in layout and test time of a reference voltage generation section as well.

Further, internal voltages are generated from the same reference voltage, and rise times of the internal voltages generated in accordance with the reference voltage can be equal to each other, and therefore, the internal voltages can be made to rise at substantially the same time points, thus enabling stabilization in operations of the internal circuits.

It should be noted that in FIG. 6, the A-buffer 24*c* is provided commonly to the voltage down converters 910 and 912. Alternatively, however, the A-buffer 24*c* may be provided commonly to boosted voltage generation circuits (914 and 916) generating boosted voltages. That is, in the voltage distribution circuit 4*p*, a reference voltage may be generated commonly to a plurality of internal boosted voltages from a constant voltage.

It should be noted that in FIG. 6, the A-buffer 24*c* may generate the reference voltage Vrefs having the same level as the constant voltage Vrefd and alternatively, may generate the reference voltage having a level different from the constant voltage Vrefd.

Fourth Configuration of Voltage Distribution Circuit

Figure 7A:
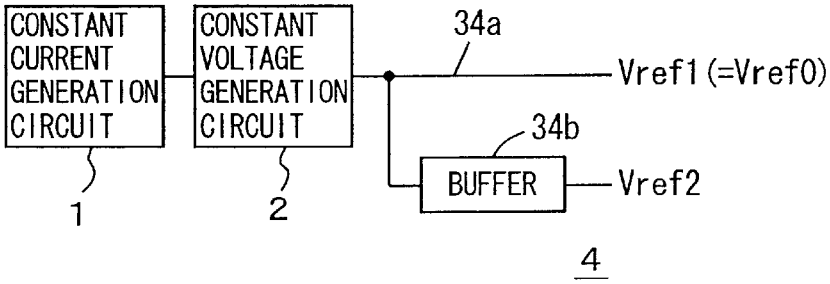
FIG. 7A is a block diagram schematically showing a fourth configuration of the voltage distribution circuit according to the present invention and FIG. 7B is of a signal waveform diagram representing an operation of the voltage distribution circuit shown in FIG. 7A.

FIG. 7A is a block diagram schematically showing a fourth configuration of the voltage distribution circuit according to the present invention. In FIG. 7A, the voltage distribution circuit 4 includes: an interconnection line 34*a* transmitting a constant (reference) voltage Vref1 from a constant voltage generation circuit 2; and a buffer 34*b* generating a reference voltage Vref2 in accordance with the constant voltage Vref1 from the constant voltage generation circuit 2. The reference voltages Vref1 and Vref2 may be used for generating power supply voltages and alternatively, may be used for generating boosted voltages. Further, the buffer 34*b* may be provided with a function of making an output voltage different in level from an input voltage.

Figure 7B:
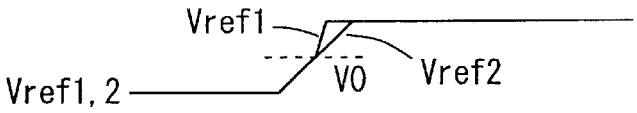

In the configuration shown in FIG. 7A, the buffer 34*b* generates the reference voltage Vref2 by buffering the reference voltage Vref1 (= the constant voltage Vref0). Therefore, as shown in FIG. 7B, the reference voltage Vref1 rises to a stable state after power is turned on and thereafter, the reference voltage Vref2 rises to attain a stable state. In FIG. 7B, after the reference voltage Vref1 exceeds a voltage value V0, the reference voltage Vref1 is rising to the stable state at a high speed. This is because all MOS transistors constituting impedance elements are turned on in the constant voltage generation circuit 2 by a current of the constant current generation circuit 1 at the voltage value V0 and a voltage corresponding to the constant current is generated. The buffer 34*b* adjusts a level of the reference voltage Vref2 according to the reference voltage Vref1, and therefore, the reference voltage Vref2 rises to a stable state at a timing slower than the reference voltage Vref1 depending on a response speed of the buffer 34*b*.

In the configuration shown in FIG. 7A, a timing at which the reference voltages Vref1 reaches a stable state can be set advanced compared with that of the reference voltage Vref2 at all times. Therefore, there is especially no necessity to provide buffers to the respective reference voltages Vref1 and Vref2 to adjust rise times, thereby enabling setting of lead/lag timing relationship of definite timings of internal voltages with ease.

Further, when the buffer 34*b* has a level conversion function on input/output voltages, levels of the reference voltages Vref1 and Vref2 can be set different from each other.

As described above, according to the fourth configuration of the voltage distribution circuit, a constant voltage is used as a reference voltage and buffered to generate a second reference voltage, thereby enabling setting of lead/lag relationship of rise timings (definite timings) of the first and second reference voltages with ease. Further, similar to the first to third configurations of the voltage distribution circuits as described above, the constant voltage generation circuit 2 is provided commonly to a plurality of reference voltages, thus enabling reduction in layout area of the reference voltage generation circuitry as well as decrease in test time for adjustment of a voltage level.

A constant voltage from the constant voltage generation circuit 2 is employed as the reference voltage Vref1 with the interconnection line 34*a* used. In this arrangement, in order to improve noise immunity, a stabilization capacitance (for example, a capacitance 32 of FIG. 6) may be provided.

Fifth Configuration of Voltage Distribution Circuit

Figure 8:
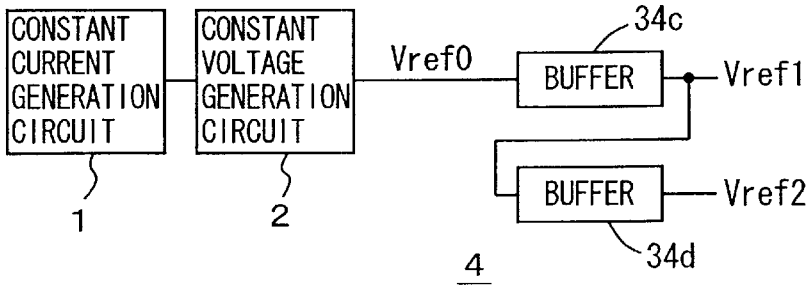
FIG. 8 is a block diagram schematically showing a fifth configuration of the voltage distribution circuit according to the present invention.

FIG. 8 is a block diagram schematically showing a fifth configuration of the voltage distribution circuit according to the present invention. As shown in FIG. 8, the voltage distribution circuit 4 includes: a buffer 34C for buffering a constant voltage Vref0 from a constant voltage generation circuit 2 to generate a reference voltage Vref1; and a buffer 34D for buffering the reference voltage Vref1 from the buffer 34*c* to generate a reference voltage Vref2. In the configuration shown in FIG. 8, the buffer 34D buffers the reference voltage Vref1 in an analog fashion to generate the reference voltage Vref2. The buffers 34*c* and 34*d* are each constituted of a current mirror differential amplifier, and therefore, the reference voltage Vref2 attains a stable state after the reference voltage Vref1 attains a stable state.

Accordingly, in this case as well, the sequence of rise of the reference voltages Vref1 and Vref2 can be set with ease, similar in operation to the configuration shown in FIG. 7A. Further, the buffer 34*c* buffers the constant voltage Vref0 from the constant voltage generation circuit 2 to generate the reference voltage Vref1, thereby enabling improvement on noise immunity of the reference voltage Vref1. Still further, the constant voltage Vref0 from the constant voltage generation circuit 2 is merely required to charge the gate in the differential stage included in the buffer 34*c*, thereby enabling stable generation of the constant voltage Vref0. Further the reference voltage Vref1 can also be generated by the buffer 34*c* in a stable manner regardless of a load to be driven, and therefore, a rise characteristic of the reference voltage Vref1 can be improved and accordingly, a rise characteristic of the reference voltage Vref2 can also be stabilized.

Sixth Configuration of Voltage Distribution Circuit

Figure 9:
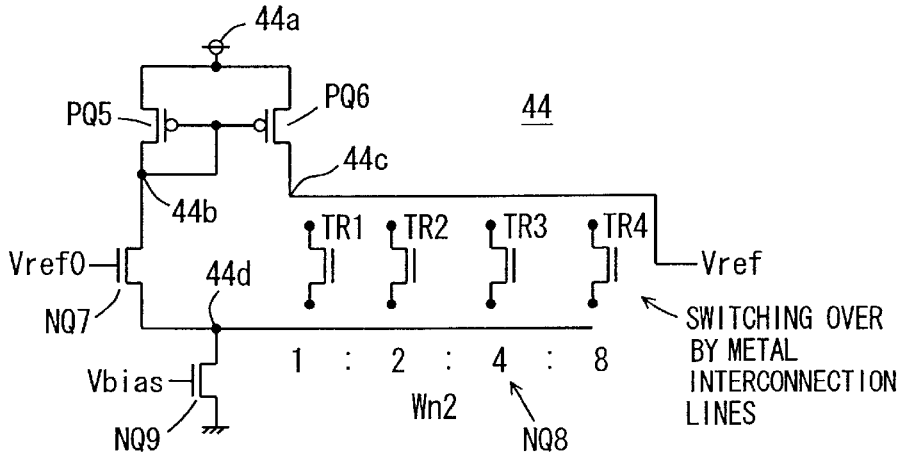
FIG. 9 is a circuit diagram schematically showing a configuration of A-buffer circuit included in a sixth configuration of the voltage distribution circuit according to the present invention.

FIG. 9 is a circuit diagram schematically showing a configuration of a buffer employed in a voltage distribution circuit according to the present invention. In FIG. 9, the buffer 44 includes: a P channel MOS transistor PQ5 connected between a power supply node 44*a* and a node 44*b*, and having a gate connected to the node 44*b*; a P channel MOS transistor PQ6 connected between the power supply node 44*a* and a node 44*c*, and having a gate connected to the node 44*b*; an N channel MOS transistor NQ7 connected between the node 44*b* and a node 44*d*, and receiving a constant voltage Vref0 at a gate thereof; an N channel MOS transistor NQ8 connected between the node 44*c* and the node 44*d*; and an N channel MOS transistor NQ9 connected between the node 44*d* and a ground node, and receiving a bias voltage Vbias at a gate thereof.

The MOS transistor NQ8 includes a plurality of N channel MOS transistors TR1 to TR4 having respective channel widths different from one another but all having the same channel lengths. The N channel MOS transistors TR1 to TR4 are selectively connected to the nodes 44*c* and 44*d* by metal interconnections. The channel widths Wn2 of respective MOS transistors TR1 to TR4 are set to, for example, a ratio of 1:2:4:8 and accordingly a channel width of the MOS transistor NQ8 connected between the nodes 44*c* and 44*d* can be adjusted. Accordingly, a level of the reference voltage Vref can be adjusted by changing the channel width.

In switching over in metal interconnection lines, connection of the reference voltage Vref is selectively formed to the gates of the MOS transistors TR1 to TR4. In the switching over in metal interconnection lines, one MOS transistor may be connected between the nodes 44*c* and 44*d*, or a number of MOS transistors may be connected between the nodes 44*c* and 44*d*. Hence, interconnections (contacts or the like) to transistors are only switched over according to a level of the reference voltage Vref, therefore enabling reduction in number of masks necessary for alteration of a level of the reference voltage Vref when compared with a case where one MOS transistor NQ8 is employed to be fabricated individually according to a level of the reference voltage Vref.

First Example Modification

Figure 10:
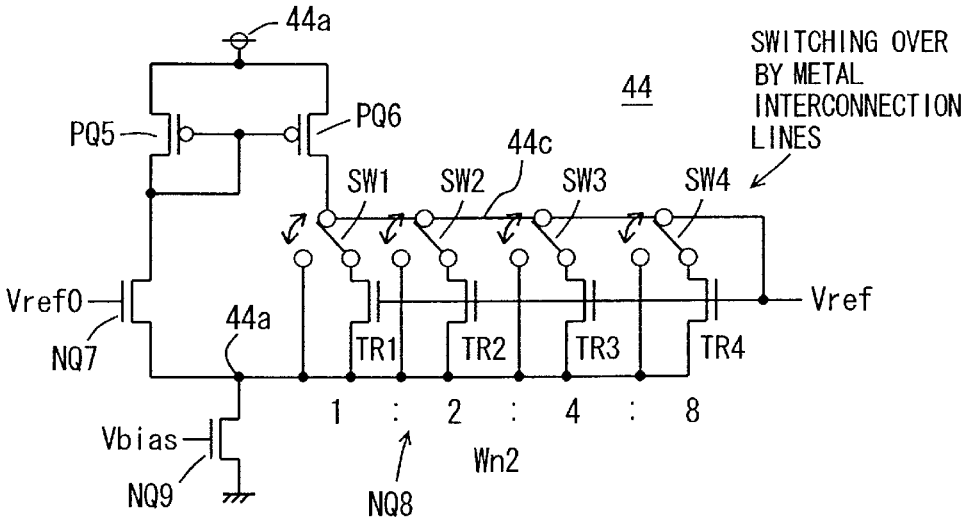
FIG. 10 is a circuit diagram representing a modification of the buffer circuit in the sixth configuration of the voltage distribution circuit according to the present invention.

FIG. 10 is a circuit diagram representing a first modification of the buffer 44 included in the sixth configuration of the voltage distribution circuit. In the buffer 44 shown in FIG. 10, transistors TR1 to TR4 are provided in parallel between an output node 44*c* and an internal node 44*d* and switch circuits SW1 to SW4 are provided in series to the respective transistors TR1 to TR4. The switch circuits SW1 to SW4 have respective connection paths set by metal interconnection lines. That is, in the MOS transistors TR1 to TR4, their drain nodes are connected selectively to the output node 44*c* or the internal node 44*d* by the switch circuits SW1 to SW4. The output node 44*c* is connected commonly to the gates of the MOS transistors TR1 to TR4, to which a reference voltage Vref is applied. The other part of the configuration is the same as the buffer 44 shown in FIG. 9 and corresponding components are denoted with the same reference numerals.

In the configuration of the buffer 44 shown in FIG. 10, connection paths of the switch circuits SW1 to SW4 are set by metal interconnection lines. Hence, upon setting a channel width of the MOS transistor NQ8, the channel width of the MOS transistor NQ8 is adjusted simply by alteration of connection paths of the switch circuits SW1 to SW4, thereby enabling adjustment of a level of the reference voltage Vref. Accordingly, a smaller number of masks is required for switching over of connection paths of the switch circuits SW1 to SW4 by the metal interconnection lines.

It should be noted that in the configuration of the buffer 44 shown in FIG. 10, a transistor TRi not-used in the MOS transistor NQ8 acts as a MOS capacitor for the reference Vref through a switch circuit SWi. Hence, the not-used transistor TRi can be made to act as a stabilization capacitance for the reference voltage Vref.

Second Example Modification

Figure 11A:
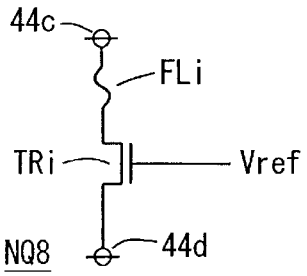
FIG. 11A is a circuit diagram representing a second a modification of the sixth configuration of the voltage distribution circuit according to the present invention and FIG. 11B is a circuit diagram representing a third a modification of the sixth configuration of the voltage distribution circuit.

FIG. 11A is a circuit diagram schematically showing a configuration of a main part of a second modification of the buffer 44. In FIG. 11 A, there is shown a part associated with a transistor TRi of a component of the MOS transistor NQ8 receiving the reference voltage Vref at the gate thereof. A fuse element FLi is connected in series to the transistor TRi. The fuse element FLi is a link element capable of being blown (open-circuit by melting). When the fuse element FLi is conductive, the transistor TRi is connected between the output node 44*c* and the internal node 44*d*. On the other hand, when the fuse element FLi is in a blown-off state, the transistor TRi is disconnected from the output node 44*c*. Hence, in such a configuration as well, the number of used transistors included in the MOS transistor NQ8 can be adjusted, thereby enabling adjustment of a level of the reference voltage Vref. Especially, when the fuse element FLi is employed, the reference voltage Vref can be set to a desired level after a test step is completed and a level of the reference voltage Vref is actually verified.

Third Example Modification

Figure 11B:
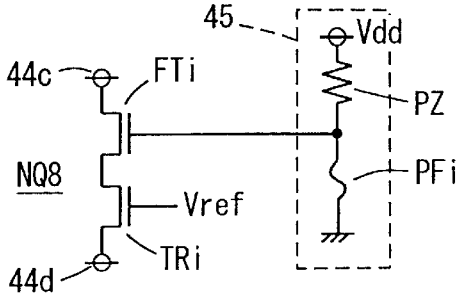

FIG. 11B is a circuit diagram representing a configuration of a third modification of the buffer 44. In FIG. 11B as well, a configuration of a part associated with the transistor TRi of the MOS transistor NQ8 is shown. In the configuration shown in FIG. 11B, a transistor element FTi for programming is connected in series to the transistor TRi. Conduction/non-conduction of the programming transistor FTi is set by a signal from a program circuit 45. In the program circuit 45, connection paths are provided corresponding to the respective transistors TR1 to TR4. In FIG. 11, a configuration of a part associated with the programming transistor element FTi of the program circuit 45 is shown. The program circuit 45 includes a pull-up resistance PZ and a fuse element PFi for programming connected in series between a power supply node and a ground node. A resistance value of the pull-up resistance PZ is set to be large. When the fuse element PFi for programming is conductive, a gate potential of the transistor element FTi for programming is at L level and rendered non-conductive to disconnect the transistor TRi from the output node 44*c*. On the other hand, when the fuse element PFi is blown, the gate potential of the transistor element FTi for programming is at H level and rendered conductive to couple the transistor TRi to the output node 44*c*.

In the configuration shown in FIG. 11B as well, by blowing/non-blowing of the fuse element PFi for programming, a channel width of the MOS transistor NQ8 can be adjusted, which enables setting of a level of the reference voltage Vref. Further, the programming fuse element PFi is blown or not blown after measurement of a level of the reference voltage Vref, thus enabling setting a desired level of the reference voltage Vref correctly.

Furthermore, when a test signal is supplied to the program circuit 45 to cause the program circuit 45 to generate a test signal for setting a state of the transistor TRi forcibly, a test can be effected with a level of the reference voltage Vref altered in a test mode. Hence, a position of a transistor to be connected in the buffer 44 can be correctly identified according to a result of the test.

It should be noted that in FIG. 11B, the programming circuit 45 may be configured to output a signal at L level when a fuse element PFi for programming is to be blown.

Further, the number of transistors included in the MOS transistor NQ8 of the buffer 44 is not limited to 4, and any number of transistors may be provided therein. A proper number of transistor elements is required to be provided according to a range of alteration of the reference voltage Vref.

Still further, a configuration similar to the MOS transistor NQ8 may also be applied to the MOS transistor PQ5 at the current mirror stage in order that a current supplying ability (a channel width) can be varied.

As described above, according to the sixth configuration of the voltage distribution circuit, an equivalent channel width of transistors of components of a buffer is set programmably, thereby enabling alteration of a level of the reference voltage Vref.

Seventh Configuration of Voltage Distribution Circuit

Figure 12:
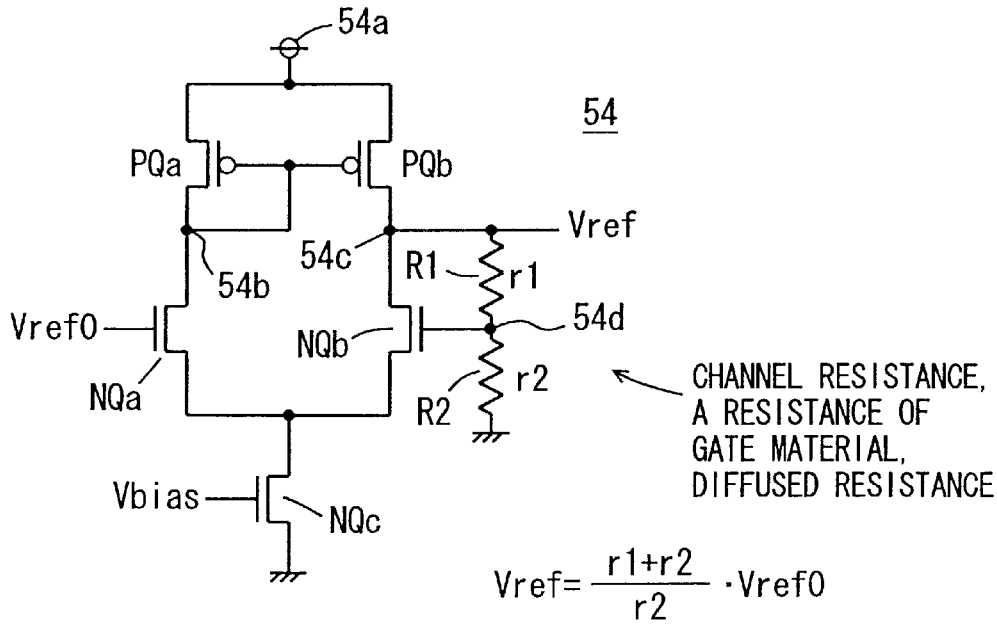
FIG. 12 is a circuit diagram representing A-buffer circuit included in a seventh configuration of the voltage distribution circuit according to the present invention.

FIG. 12 is a circuit diagram representing a seventh configuration of a voltage distribution circuit according to the present invention. In FIG. 12, a configuration of a buffer 54 included in the voltage distribution circuit is shown. The buffer 54 generates a reference voltage Vref having a level different from a constant voltage Vref0 from the constant voltage Vref0.

The buffer 54 includes: P channel MOS transistors PQa and PQb constituting a current mirror stage; N channel MOS transistors NQa and NQb constituting a differential stage; and a current source transistor NQc restricting a current flowing through a current mirror circuit. The gate and drain of the MOS transistor PQa are connected to a node 54*b* and the MOS transistor PQa functions as a master in the current mirror stage. The MOS transistor NQa receives the constant voltage Vref0 at a gate thereof and the current source transistor NQc receives a bias voltage Vbias at a gate thereof.

The buffer 54 further includes resistance elements R1 and R2 connected in series between an output mode 54*c* and a ground node. The resistance elements R1 and R2 have resistance values of r1 and r2, respectively. A connection node 54*b* connecting to the resistance elements R1 and R2 is connected to the gate of the MOS transistor NQb.

The resistance elements R1 and R2 constitute a voltage divider circuit and convert a level of the reference voltage Vref to a voltage level of (r2/(r1+r2))·Vref to output the converted voltage. When a mirror ratio is 1 in a current mirror differential amplifier circuit constructed of the MOS transistors PQa, PQb, NQa and NQb, a relationship between the reference voltage Vref and the constant voltage Vref0 is expressed by the following formula:

$$Vref=Vref0\cdot(r1+r2)/r2$$

Accordingly, the reference voltage Vref is at a level higher than the constant voltage Vref0. Thus, when a reference voltage having a level different from a constant voltage is generated in any one of the configurations of the voltage distribution circuit, the reference voltage Vref having a level different from the constant voltage Vref0 can be generated using a resistive voltage divider with a mirror ratio of 1 in the current mirror differential amplifier circuit maintained.

The buffer 54 is not required to have a large current driving ability (merely required to drive a gate capacitance of a circuit at the next stage). Hence, when a resistive voltage divider circuit is connected to output node 54*c* of the buffer 54, a through current flowing through the voltage divider circuit can be sufficiently small. That is, a steady-state current of Vref/(r1+r2) flows from the output node 54*c* toward a ground mode. The resistance values r1 and r2 of the resistance elements R1 and R2 are set large enough for the steady-state current to fall within an allowable range. Generally, as a resistance, a gate electrode material of a transistor (for example, of a sheet resistance of about 10 Ω), a diffused layer (of a sheet resistance of about 200 Ω) or the like can be preferably used. The resistance elements of the voltage divider circuit can be fabricated in the same processing steps as the gate electrode and a diffused layer.

For example, when the reference voltage Vref is 2 V and a through current in the voltage divider circuit is restricted to 20 μA, a value of the combined resistance value r1+r2 has to be 100 Ω. If the resistance value is to be achieved with placement of a metal interconnection line resistance (a resistance made of a gate electrode material) with a interconnect width of 0.3 μm, a length of about 3000 μm thereof is necessary. When a diffused resistance is used, a necessary resistance of 100 kΩ can be realized with a length of about 150 μm.

Further, the resistance elements R1 and R2 may be realized with a channel resistance. Still further, when the resistance values of r1 and r2 of resistance element R1 and R2 are equal to each other, the reference voltage Vref is generated at a level 2 times as high as the constant voltage Vref0. In this case, a bit line precharge voltage VBL used for precharge/equalization of a bit line is generated in accordance with the constant voltage Vref0, and when a power supply voltage Vdds for a sense amplifier is generated in accordance with the reference voltage Vref, a bit line precharge voltage can be set correctly to an intermediate voltage level (1/2) of an array power supply voltage Vdds.

A voltage distribution circuit including the buffer 54 shown in FIG. 12 may be of any of the first to sixth configurations of the voltage distribution circuit. The buffer 54 shown in FIG. 12 is sufficiently used for a buffer for generating a reference voltage having a level different from a constant voltage.

As described above, according to the seventh configuration of the voltage distribution circuit, a reference voltage outputted form a buffer is voltage-divided for comparison with a constant voltage, thereby enabling generation of a reference voltage having a level different from a level of the constant voltage. Further, since a through current of a buffer is small, a through current flowing in a steady-state can be further reduced when compared with a case where a level of an internal power supply voltage is made different from a reference voltage through resistance division in an actual internal voltage down converter (VDC), thereby enabling reduction in a consumed current.

Eighth Configuration of Voltage Distribution Circuit

Figure 13:
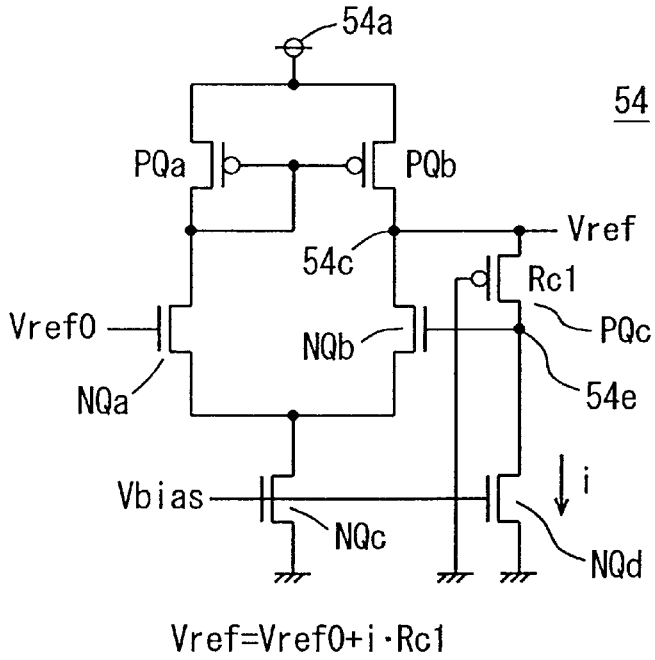
FIG. 13 is a circuit diagram representing a configuration of A-buffer circuit of an eighth configuration of the voltage distribution circuit according to the present invention.

FIG. 13 is a circuit diagram representing an eighth configuration of the voltage distribution circuit according to the present invention. In a buffer 54 shown in FIG. 13, a current mirror differential amplifier circuit has a mirror ratio of 1, similar to the buffer 54 shown in FIG. 12. Corresponding components of the current mirror differential amplifier circuits in FIGS. 12 and 13 are denoted with the same reference numerals.

In the buffer 54 shown in FIG. 13, a P channel MOS transistor PQc and an N channel MOS transistor NQd are further provided and connected in series between an output node 54*c* and a ground node. The gate of the P channel MOS transistor PQc is connected to the ground node and when a reference voltage Vref is equal to or higher than the absolute value of threshold voltage of the P channel MOS transistor PQc, the P channel MOS transistor PQc is rendered conductive to have a channel resistance Rc1. The N channel MOS transistor NQd receives a bias voltage Vbias at the gate thereof to conduct a constant current i. Hence, a voltage of Vref−i·Rc1 is generated at a connection node 54*e* connecting the MOS transistors PQc and NQd. When a level shift is effected with a constant current, the reference voltage Vref and the constant voltage Vref0 are correlated with each other in the following formula:

$$Vref=Vref0+i\cdot Rc1.$$

A value of the constant current i can be sufficiently small by the action of bias voltage Vbias and a necessary voltage drop (level shift) can be realized by channel resistance Rc1. Accordingly, a through current for level shifting the reference voltage can be reduced due to the constant current i supplied by the MOS transistor NQd serving as a current source. A layout area of the level conversion circuit can be sufficiently small by utilizing the MOS transistors PQc and NQd.

It should be noted that in the buffer 54 shown in FIG. 13, the bias voltage Vbias is provided commonly to the gates of the transistors NQc and NQd, both serving as current sources. With mutually different sizes (a ratio of a channel width and a channel length) of the MOS transistors NQc and NQd, an operating current of the current mirror differential amplifier circuit and the constant current in the circuit for level shift can be made different from each other.

As described above, according to the eighth configuration of the voltage distribution circuit, a level shift of a reference voltage is achieved with a constant current and a channel resistance and therefore, a reference voltage Vref having a necessary level can be generated with ease while restricting increase/decrease in through current and layout size.

Ninth Configuration of Voltage Distribution Circuit

Figure 14:
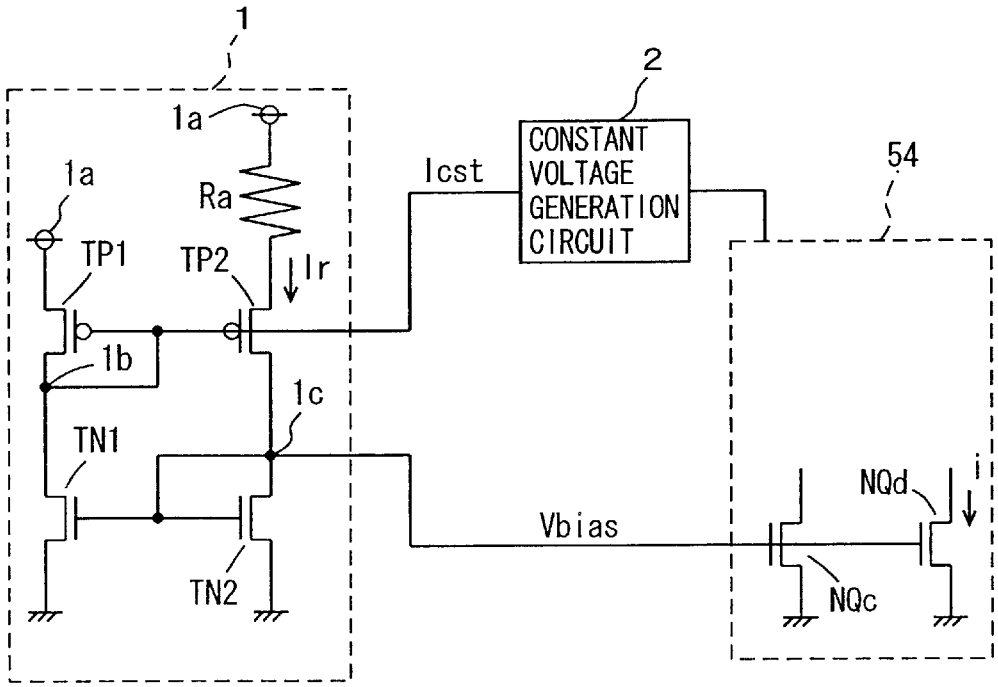
FIG. 14 is a block diagram schematically showing a ninth configuration of the voltage distribution circuit according to the present invention.

FIG. 14 is a block diagram schematically showing a configuration of a main part included in the voltage distribution circuit. In the configuration shown in FIG. 14, the buffer 54 has the configuration shown in FIG. 13 and includes: a current source transistor NQc of a current mirror differential amplifier circuit; and a current source transistor NQd for level shifting a reference voltage. The bias voltage Vbias applied on the gates of these MOS transistors is supplied from a constant current generation circuit 1. That is, in the constant current generation circuit 1, a voltage on a node 1*c* to which the gate and drain of a MOS transistor TN2 are connected is used as the bias voltage Vbias. In a case of the configuration, MOS transistors TN2, NQc and NQd constitute a current mirror circuit and a constant current Icst flows through the MOS transistors NQc and NQd. With such a configuration, the bias voltage Vbias can be generated without providing a dedicated circuit for generating the bias voltage. When a mirror ratio of the MOS transistors NQc and Nqd to the MOS transistor TN2 is adjusted to an appropriate value, necessary currents can be provided in the current mirror differential amplifier circuit and the level conversion circuit.

Further, the configuration in which the bias voltage Vbias is utilized in the buffer 54 may be employed for the bias voltage Vbias applied to a buffer included in the first configuration et. seq.

Entire Configuration of Semiconductor Integrated Circuit Device

Figure 15:
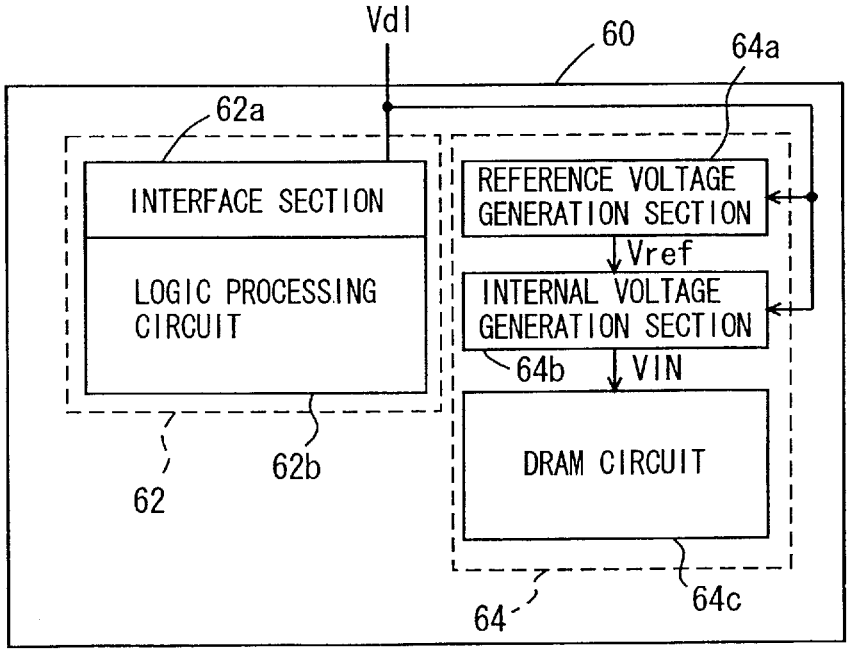
FIG. 15 is a block diagram schematically showing the entire configuration of a semiconductor integrated circuit device to which the present invention is applied.
Figure 16:
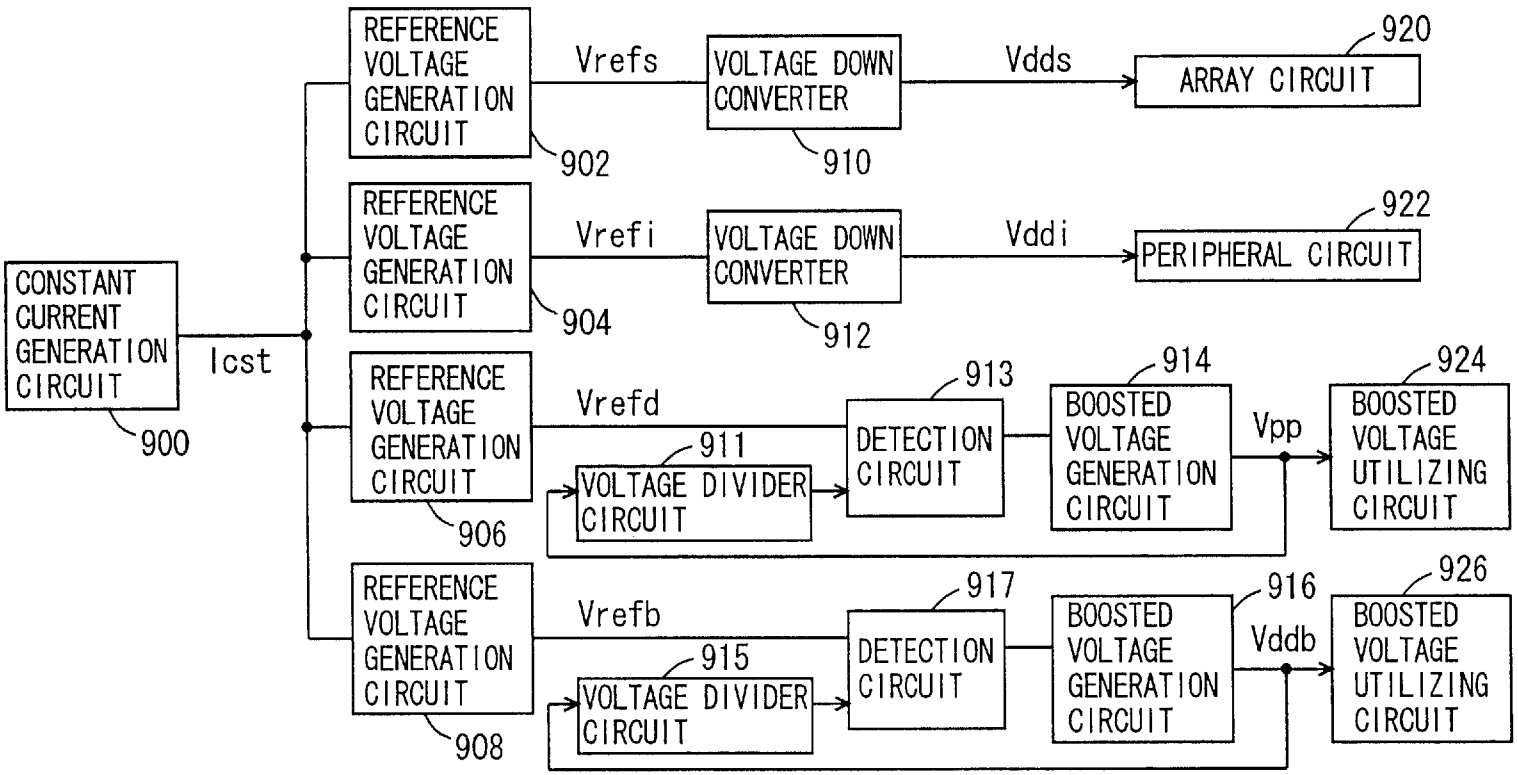
FIG. 16 PRIOR ART
FIG. 16 is a block diagram schematically showing a configuration of an internal voltage generation section in a conventional semiconductor integrated circuit device.
Figure 17:
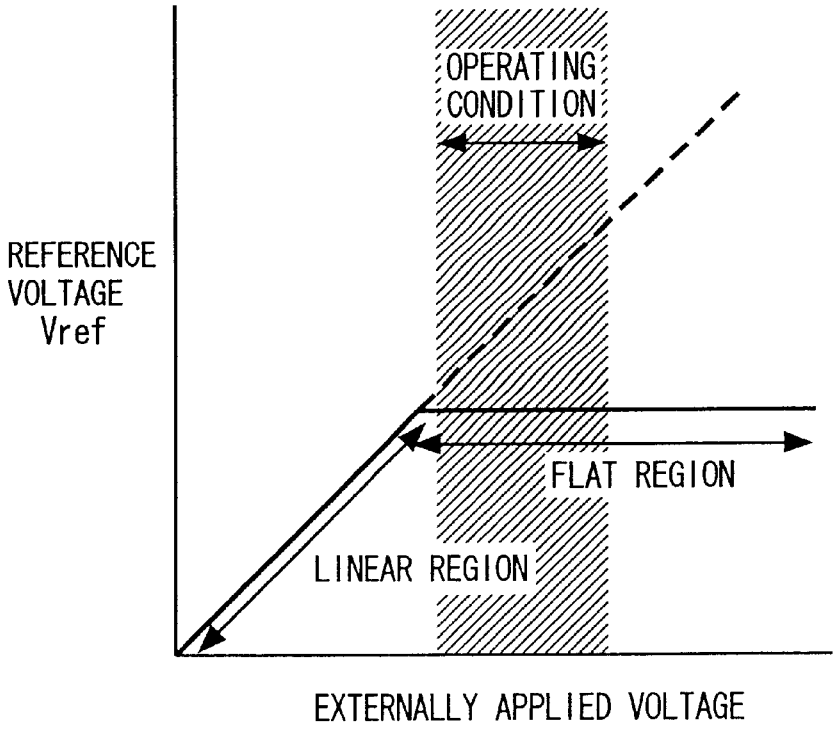
FIG. 17 PRIOR ART
FIG. 17 is a graph showing a relationship between a reference voltage and an externally applied voltage.
Figure 18:
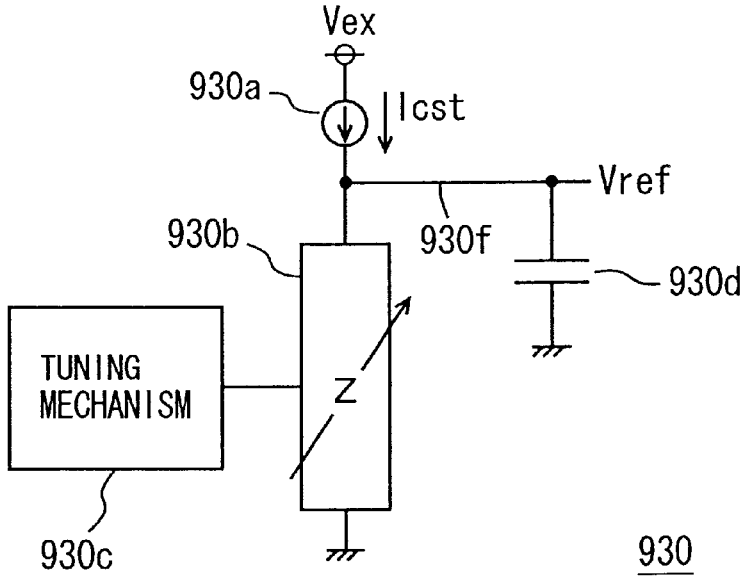
FIG. 18 PRIOR ART
FIG. 18 is a block diagram schematically showing a configuration of a conventional reference voltage generating circuit.

FIG. 15 is a block diagram representing an example of the entire configuration of a semiconductor integrated circuit device to which the present invention is applied. In FIG. 15, a semiconductor integrated circuit device 60 includes a logic 62 and a DRAM macro 64 integrated on the same semiconductor chip. The logic 62 includes: an interface section 62*a* for performing input/output of data from and to an outside; and a logic processing section 62*b* performing transmission and receiving of a data/signal through the interface section 62*a* and a necessary logic processing. A power supply voltage Vd1 is applied to the interface section 62*a*.

The DRAM macro 64 includes: a reference voltage generation section 64*a* receiving a voltage Vd1 applied to the interface section 62*a* of the logic as an external power supply voltage to generate a reference voltage Vref; an internal voltage generation section 64*b* generating a necessary internal voltage VIN in accordance with the reference voltage from the reference voltage generation section 64*a*; and a DRAM circuit 64*c* performing an operation requested by the logic 62 with the internal voltage VIN from the internal voltage generation section 64*b*. The DRAM circuit 64*c* performs supply/receiving of a data/signal with the logic 62.

The reference voltage generation circuit 64*b* includes a constant current generation circuit 1, a constant voltage generation circuit 2 and a voltage distribution circuit 4, and generates a plurality of reference voltages Vref. The internal voltage generation section 64*b* receives a voltage Vd1 of the logic interface section 62*a* as an external power supply voltage to generate necessary internal voltages VIN in accordance with the reference voltages from the reference voltage generation section 64*a*. The internal voltage generation section 64*b* includes a voltage down converter and a voltage boosting circuit. The DRAM circuit 64*c* includes a DRAM memory cell array, a row/column selection circuit and a data input/output circuit.

Accordingly, when a logic and a DRAM are integrated on the same semiconductor chip as shown in FIG. 15, an occupancy area of the reference voltage generation section 64*a* is reduced and thereby in the semiconductor integrated circuit device 60, an occupancy area of the DRAM macro 64 can be reduced to realize a highly integrated system LSI.

Other Applications

In the above described embodiments according to the present invention, an internal voltage is described being used in DRAM. The present invention, however, can be applied to any semiconductor devices, as far as an internal voltage is internally generated in accordance with a reference voltage.

As described above, according to the present invention, in a semiconductor integrated circuit device using a plurality of reference voltages, a constant voltage generation circuit is provided commonly to the plurality of the reference voltages and thereby, a layout area can be reduced and in addition, a test time for voltage adjustment can be shorter, leading to reduced cost. Furthermore, by generating a plurality of reference voltages from one constant voltage, rise times of the reference voltages (a time consumed till a definite state is established) can be optimized, thus enabling optimization of rise times (a time consumed till a definite state is established) of internal voltages.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device comprising:

a constant current generation circuit for generating a constant current;

a current/voltage conversion circuit provided individually and separately from said constant current generation circuit, for generating a constant voltage in accordance with said constant current received from said constant current generation circuit;

a voltage distribution circuit, provided individually and separately from said constant current generation circuit and receiving said constant voltage, for generating at least one reference voltage; and an internal voltage generation circuit for generating a plurality of internal voltages in accordance with said at least one reference voltage from said voltage distribution circuit.

2. The semiconductor device according to claim 1, wherein said voltage distribution circuit includes a buffer circuit to receive and buffer in an analog fashion said constant voltage for outputting said reference voltage.

3. The semiconductor device according to claim 2, wherein said at least one reference voltage comprises a plurality of reference voltages and said buffer circuit comprises a plurality of analog buffers provided corresponding to the respective reference voltages.

4. The semiconductor device according to claim 3, wherein the plurality of the reference voltages generated by said plurality of analog buffers are different in voltage level from each other.

5. The semiconductor device according to claim 3, wherein the reference voltages generated by said plurality of analog buffers are equal in voltage level to each other, and said internal voltage generation circuit comprises a plurality of internal power supply circuits individually and separately generating internal voltages in accordance with reference voltages from the respective analog buffers.

6. The semiconductor device according to claim 1, wherein said voltage distribution circuit comprises:

an interconnection line for transmitting the constant voltage from said current/voltage conversion circuit, and a buffer circuit for buffering said constant voltage to generate the reference voltage; and said internal voltage generation circuit comprises:

a first internal voltage circuit for generating a first internal voltage of said plurality of internal voltages in accordance with said constant voltage transmitted through said interconnection line; and a second internal voltage circuit for generating a second internal voltage of said plurality of internal voltages in accordance with said reference voltage from said buffer circuit.

7. The semiconductor device according to claim 6, wherein said reference voltage has a level different from a level of said constant voltage.

8. The semiconductor device according to claim 1, wherein said voltage distribution circuit comprises:

a first buffer circuit for buffering said constant voltage to generate a first reference voltage of said at least one reference voltage; and a second buffer circuit for further buffering said first reference voltage from said first buffer circuit to generate a second reference voltage of said at least one reference voltage.

9. The semiconductor device according to claim 8, wherein the first and second reference voltages are different in voltage level from each other.

10. The semiconductor device according to claim 1, wherein said at least one reference voltage comprises one reference voltage, said voltage distribution circuit comprises a buffer circuit to buffer said constant voltage and generate said one reference voltage, and said internal voltage generation circuit comprises a plurality of internal voltage generators for individually and separately generating internal voltages in accordance with the one reference voltage from said buffer circuit.

11. The semiconductor device according to claim 10, wherein the internal voltages generated by said plurality of internal voltage generators are equal in voltage level to each other.

12. The semiconductor device according to claim 2, wherein said buffer circuit includes a tuning mechanism for adjusting an output voltage level thereof.

13. The semiconductor device according to claim 2, wherein said buffer circuit comprises a current mirror type differential amplifier circuit.

14. The semiconductor device according to claim 13, wherein said current mirror type differential amplifier circuit comprises a differential stage receiving an associated output reference voltage and said constant voltage.

15. The semiconductor device according to claim 13, wherein said current mirror type differential amplifier circuit includes a pair of transistors at a differential stage receiving input signals to be compared to each other, said pair of transistors being different in size from each other.

16. The semiconductor device according to claim 13, wherein said current mirror type differential amplifier circuit comprises a current mirror stage serving as a current source to a differential stage for comparing input signals to each other, sizes of transistors constituting said current mirror stage are different from each other, and the reference voltage generated at an output of said current mirror type differential amplifier circuit has a level different from a level of said constant voltage.

17. The semiconductor device according to claim 13, wherein said current mirror type differential amplifier circuit comprises: a differential stage for comparing input signals with each other, sizes of transistors constituting said differential stage being different from each other; and a current mirror stage serving as a current source to said differential stage, sizes of transistors constituting said current mirror stage being different from each other; and the reference voltage generated by said current mirror type amplifier circuit at an output thereof is different in voltage level from said constant voltage.

18. The semiconductor device according to claim 13, wherein said current mirror type differential amplifier comprises a voltage divider circuit for voltage-dividing the reference voltage generating at an output of the current mirror type differential amplifier circuit, and receives a divided reference voltage outputted by said voltage divider circuit at one of differential inputs thereof.

19. The semiconductor device according to claim 18, wherein said voltage divider circuit comprises a channel resistance and a current source connected in series between said output and a reference node, said channel resistance being provided by a resistance value across an insulated gate field effect transistor when the insulated gate field effect transistor is conductive, and said current source causes a current flow through said channel resistance, and a voltage on a connection node connecting said current source and said channel resistance is applied on one of inputs of a differential stage of said current mirror type differential amplifier circuit.

20. The semiconductor device according to claim 19, wherein said current source supplies a mirror current of a current of a current source used in said constant current generation circuit.

* * * * *